US009659526B2

(12) United States Patent
Miyake

(10) Patent No.: US 9,659,526 B2
(45) Date of Patent: May 23, 2017

(54) LIGHT-EMITTING DEVICE CAPABLE OF CORRECTING VARIATION IN LUMINANCE AMONG PIXELS

(71) Applicant: Semiconductor Energy Laboratory Co., Ltd., Atsugi-shi, Kanagawa-ken (JP)

(72) Inventor: Hiroyuki Miyake, Atsugi (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

(21) Appl. No.: 14/479,630

(22) Filed: Sep. 8, 2014

(65) Prior Publication Data

US 2015/0077411 A1 Mar. 19, 2015

(30) Foreign Application Priority Data

Sep. 13, 2013 (JP) ..... 2013-190038

(51) Int. Cl.
*G09G 3/30* (2006.01)
*G09G 3/3233* (2016.01)

(52) U.S. Cl.
CPC ... *G09G 3/3233* (2013.01); *G09G 2300/0417* (2013.01); *G09G 2300/0842* (2013.01); *G09G 2300/0861* (2013.01); *G09G 2310/0291* (2013.01); *G09G 2320/0233* (2013.01); *G09G 2320/0295* (2013.01); *G09G 2320/043* (2013.01)

(58) Field of Classification Search
CPC .. G09G 3/30; G09G 3/10; G09G 5/00; G09G 3/36; G06F 3/038; G11C 19/00
USPC ..... 345/76–81
See application file for complete search history.

(56) References Cited

U.S. PATENT DOCUMENTS

| | | | |
|---|---|---|---|
| 7,046,220 | B2 | 5/2006 | Tagawa et al. |
| 7,199,771 | B2 | 4/2007 | Yamazaki et al. |
| 7,768,485 | B2 | 8/2010 | Uchino et al. |
| 7,961,160 | B2 | 6/2011 | Kimura et al. |
| 8,446,397 | B2 | 5/2013 | Kimura |
| 8,692,743 | B2 * | 4/2014 | Tsai ..... G09G 3/3233 345/76 |

(Continued)

FOREIGN PATENT DOCUMENTS

| | | |
|---|---|---|
| JP | 2007-310311 | 11/2007 |
| JP | 2009-265459 | 11/2009 |

*Primary Examiner* — Pegeman Karimi
(74) *Attorney, Agent, or Firm* — Robinson Intellectual Property Law Office; Eric J. Robinson

(57) ABSTRACT

A light-emitting device is provided, which is capable of correcting variation in luminance among pixels due to variation in electrical characteristics, such as threshold voltage or mobility, among driving transistors in a period where image display is performed. The light-emitting device includes a pixel; a first circuit configured to generate a signal including information about a value of current extracted from the pixel; and a second circuit configured to correct an image signal in accordance with the signal. The pixel includes a light-emitting element; a transistor whose drain current has a value determined in accordance with the image signal; a first switch configured to control supply of the drain current to the light-emitting element; and a second switch configured to control extraction of the drain current from the pixel and control the supply of the drain current to the light-emitting element.

18 Claims, 24 Drawing Sheets

(56) References Cited

U.S. PATENT DOCUMENTS

| | | | | |
|---|---|---|---|---|
| 8,816,942 | B2 * | 8/2014 | Schwanenberger | G09G 3/3233 315/169.3 |
| 2003/0090446 | A1 * | 5/2003 | Tagawa | G09G 3/3233 345/76 |
| 2009/0160742 | A1 * | 6/2009 | Mizukoshi | G09G 3/3233 345/77 |
| 2010/0289782 | A1 * | 11/2010 | Yamamoto | G09G 3/3233 345/207 |
| 2012/0287177 | A1 | 11/2012 | Koyama et al. | |
| 2013/0063413 | A1 | 3/2013 | Miyake | |
| 2013/0092930 | A1 | 4/2013 | Kimura | |
| 2013/0169170 | A1 * | 7/2013 | Shih | H05B 33/0815 315/173 |
| 2013/0241431 | A1 | 9/2013 | Toyotaka et al. | |
| 2013/0320848 | A1 | 12/2013 | Miyake et al. | |
| 2014/0354698 | A1 * | 12/2014 | Lee | G09G 3/3258 345/690 |
| 2015/0061533 | A1 | 3/2015 | Miyake et al. | |

* cited by examiner

LIGHT-EMITTING DEVICE CAPABLE OF CORRECTING VARIATION IN LUMINANCE AMONG PIXELS

BACKGROUND OF THE INVENTION

1. Field of the Invention

The present invention relates to an object, a method, or a manufacturing method. In addition, the present invention relates to a process, a machine, manufacture, or a composition of matter. One embodiment of the present invention particularly relates to a semiconductor device, a display device, a light-emitting device, a power storage device, a driving method thereof, or a manufacturing method thereof. One embodiment of the present invention particularly relates to a light-emitting device in which a transistor is provided in each pixel.

2. Description of the Related Art

In an active matrix light-emitting device including light-emitting elements, when the threshold voltages of transistors for controlling the value of current supplied to the light-emitting elements in accordance with image signals (such transistors are also referred to as driving transistors) vary, the luminances of the light-emitting elements vary accordingly. As a means for preventing the variation in luminance among the light-emitting elements due to the variation in threshold voltage, a display device which corrects, inside pixels, variation in luminance among the light-emitting elements due to variations in threshold voltage and mobility is disclosed in Patent Document 1. Patent Document 2 discloses a display device which determines threshold voltage and mobility from a source voltage of a driving transistor and sets a program data signal based on the determined threshold voltage and mobility depending on a display image.

PATENT DOCUMENTS

[Patent Document 1] Japanese Published Patent Application No. 2007-310311

[Patent Document 2] Japanese Published Patent Application No. 2009-265459

SUMMARY OF THE INVENTION

In the display device in Patent Document 1, it is difficult to accurately correct variation in drain current among driving transistors due to variation in mobility, and there is room for improvement in terms of image quality. A display device which corrects an image signal to prevent variation in drain current among driving transistors due to variation in threshold voltage and mobility, like the display device in Patent Document 2, cannot display an image while correcting an image signal. Therefore, the correction of an image signal needs to be performed in a specific short period which is not involved in image display, such as in a flyback period, and there has been a large load on a driver circuit which controls the correction.

In view of the above-described technical background, it is an object of one embodiment of the present invention to provide a light-emitting device capable of correcting variation in luminance among pixels due to variation in electrical characteristics, such as threshold voltage or mobility, among driving transistors in a period where image display is performed. It is an object of one embodiment of the present invention to provide a novel light-emitting device. Note that the descriptions of these objects do not disturb the existence of other objects. Note that in one embodiment of the present invention, there is no need to achieve all the objects. Note that other objects will be apparent from the description of the specification, the drawings, the claims, and the like and other objects can be derived from the description of the specification, the drawings, the claims, and the like.

A light-emitting device according to one embodiment of the present invention includes a pixel; a first circuit configured to generate a signal including information about a value of current extracted from the pixel; and a second circuit configured to correct an image signal in accordance with the signal generated by the first circuit. The pixel includes a light-emitting element; a transistor whose drain current has a value determined in accordance with the image signal; a first switch configured to control supply of the drain current to the light-emitting element; and a second switch configured to control extraction of the drain current from the pixel and control the supply of the drain current to the light-emitting element.

One embodiment of the present invention can provide a light-emitting device capable of correcting variation in luminance among pixels due to variation in electrical characteristics, such as threshold voltage or mobility, among driving transistors in a period where image display is performed. One embodiment can provide a novel semiconductor device, display device, light-emitting device, or the like. Note that the descriptions of these effects do not disturb the existence of other effects. Note that in one embodiment of the present invention, there is no need to achieve all the effects. Note that other effects will be apparent from the description of the specification, the drawings, the claims, and the like and other effects can be derived from the description of the specification, the drawings, the claims, and the like.

DETAILED DESCRIPTION OF THE INVENTION

Embodiments of the present invention will be described in detail below with reference to drawings. Note that the present invention is not limited to the following description, and it will be easily understood by those skilled in the art that various changes and modifications can be made without departing from the spirit and scope of the present invention. Therefore, the present invention should not be construed as being limited to the description in the following embodiments.

Note that the term "connection" in this specification refers to electrical connection and corresponds to a state of a circuit configuration in which current, voltage, or a potential can be supplied or transmitted. Accordingly, a connection circuit means not only a state of direct connection but also a state of electrical connection through an element such as a wiring, a resistor, a diode, or a transistor so that current, voltage, or a potential can be supplied or transmitted.

In addition, even when different components are connected to each other in a circuit diagram, there is actually a case where one conductive film has functions of a plurality of components such as a case where part of a wiring functions also as an electrode. The term "connection" in this specification also means such a case where one conductive film has functions of a plurality of components.

A "source" of a transistor means a source region that is part of a semiconductor film or a source electrode that is electrically connected to the semiconductor film. Similarly, a "drain" of a transistor means a drain region that is part of a semiconductor film or a drain electrode that is electrically connected to the semiconductor film. A "gate" means a gate electrode.

The terms "source" and "drain" of a transistor interchange with each other depending on the type of the channel of the transistor or levels of potentials applied to the terminals. In general, in an n-channel transistor, a terminal to which a lower potential is applied is called a source, and a terminal to which a higher potential is applied is called a drain. In a p-channel transistor, a terminal to which a lower potential is applied is called a drain, and a terminal to which a higher potential is applied is called a source. In this specification, although connection relation of the transistor is described assuming that the source and the drain are fixed in some cases for convenience, actually, the names of the source and the drain interchange with each other depending on the relation of the potentials.

Configuration Example of Light-Emitting Device

Figure 1:
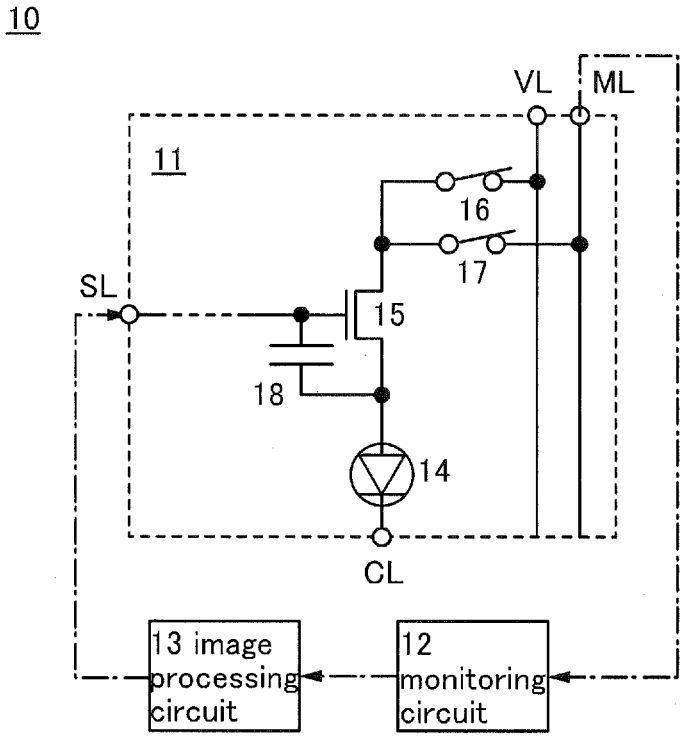
FIG. 1 illustrates a configuration example of a light-emitting device.

FIG. 1 illustrates, as an example, a configuration of a light-emitting device according to one embodiment of the present invention. A light-emitting device 10 illustrated in FIG. 1 includes a pixel 11, a monitor circuit 12, and an image processing circuit 13. The pixel 11 includes a light-emitting element 14, a transistor 15, a switch 16, a switch 17, and a capacitor 18.

Examples of the light-emitting element 14 include an element whose luminance is controlled by current or voltage, such as a light-emitting diode (LED) or an organic light-emitting diode (OLED). For example, an OLED includes at least an EL layer, an anode, and a cathode. The EL layer is formed using a single layer or a plurality of layers provided between the anode and the cathode, at least one of which is a light-emitting layer containing a light-emitting substance. From the EL layer, electroluminescence is obtained by current supplied when a potential difference between the cathode and the anode is larger than or equal to the threshold voltage of the light-emitting element 14. Electroluminescence includes luminescence (fluorescence) at the time of returning from a singlet-excited state to a ground state and luminescence (phosphorescence) at the time of returning from a triplet-excited state to a ground state.

The value of the drain current of the transistor 15 is determined in accordance with an image signal which is input to the pixel 11 through a wiring SL. Note that in addition to a normal gate (a first gate), the transistor 15 may include a back gate (a second gate) for controlling the threshold voltage. Note that FIG. 1 illustrates the case where the transistor 15 is an n-channel transistor, and one of a source and a drain of the transistor 15 is connected to the anode of the light-emitting element 14. In the case where the transistor 15 is a p-channel transistor, the source of the transistor 15 is connected to the cathode of the light-emitting element 14.

The switch 16 has a function of controlling supply of the drain current of the transistor 15 to the light-emitting element 14. The switch 17 has a function of controlling extraction of the drain current of the transistor 15 from the pixel 11 and a function of controlling the supply of the drain current of the transistor 15 to the light-emitting element 14. Specifically, the switch 16 has a function of controlling electrical connection between the other of the source and the drain of the transistor 15 and a wiring VL. The switch 17 has a function of controlling electrical connection between the other of the source and the drain of the transistor 15 and a wiring ML. The drain current of the transistor 15 which is extracted to the wiring ML through the switch 17 is supplied to the monitor circuit 12.

The switch 16 or the switch 17 may include one or more transistors, for example. Alternatively, the switch 16 or the switch 17 may include a capacitor in addition to one or more transistors.

Note that, in this specification and the like, any of a variety of switches can be used as the switch. The switch has a function of determining whether current flows or not by being turned on or off (becoming an on state or an off state). Alternatively, the switch has a function of selecting and changing a current path. For example, the switch has a function of determining whether current flows through a path 1 or a path 2 and switching the paths. For example, an electrical switch, a mechanical switch, or the like can be used as a switch. That is, any element can be used as a switch as long as it can control current, without limitation to a certain element. Examples of the switch include a transistor (e.g., a bipolar transistor or a MOS transistor), a diode (e.g., a PN diode, a PIN diode, a Schottky diode, a metal-insulator-metal (MIM) diode, a metal-insulator-semiconductor (MIS) diode, or a diode-connected transistor), and a logic circuit combining such elements. An example of a mechanical switch is a switch formed using a micro electro mechanical system (MEMS) technology, such as a digital micromirror device (DMD). The switch includes an electrode which can be moved mechanically, and operates to control conduction and non-conduction with the movement of the electrode.

In the case where the transistor 15 is an n-channel transistor, the cathode of the light-emitting element 14 is connected to a wiring CL. In the case where the potential of the wiring VL is higher than a potential obtained by adding the threshold voltage Vthe of the light-emitting element 14 and the threshold voltage Vth of the transistor 15 to the potential of the wiring CL, when the switch 16 is turned on, the drain current of the transistor 15 is supplied to the light-emitting element 14. The luminance of the light-emitting element 14 is determined by the value of the drain current. In the case where the potential of the wiring ML is higher than the potential obtained by adding the threshold voltage Vthe of the light-emitting element 14 and the threshold voltage Vth of the transistor 15 to the potential of the wiring CL, when the switch 17 is turned on, the drain current of the transistor 15 is supplied to the light-emitting element 14. The luminance of the light-emitting element 14 is determined by the value of the drain current.

In the case where the transistor 15 is a p-channel transistor, the anode of the light-emitting element 14 is connected to the wiring CL. In the case where the potential of the wiring CL is higher than the potential obtained by adding the threshold voltage Vthe of the light-emitting element 14 and the threshold voltage Vth of the transistor 15 to the potential of the wiring VL, when the switch 16 is turned on, the drain current of the transistor 15 is supplied to the light-emitting element 14. The luminance of the light-emitting element 14 is determined by the value of the drain current. In the case where the potential of the wiring CL is higher than the potential obtained by adding the threshold voltage Vthe of the light-emitting element 14 and the threshold voltage Vth of the transistor 15 to the potential of the wiring ML, when the switch 17 is turned on, the drain current of the transistor 15 is supplied to the light-emitting element 14. The luminance of the light-emitting element 14 is determined by the value of the drain current.

The capacitor 18 has a function of holding a potential difference between the gate and the one of the source and the drain of the transistor 15. Note that the capacitor 18 is not necessarily provided in the pixel 11 when gate capacitance formed between the gate and a semiconductor film of the transistor 15 is sufficiently large, for example.

The pixel 11 may include a circuit element such as a transistor, a capacitor, a resistor, or an inductor in addition to the light-emitting element 14, the transistor 15, the switch 16, the switch 17, and the capacitor 18.

The monitor circuit 12 has a function of generating a signal including information about the value of the drain current of the transistor 15 by using the drain current extracted from the pixel 11 through the switch 17. For example, a current-voltage converter circuit such as an integrator circuit can be used as the monitor circuit 12.

The image processing circuit 13 has a function of correcting an image signal which is input to the pixel 11, in accordance with the signal generated by the monitor circuit 12. Specifically, in the case where it is determined from the signal generated by the monitor circuit 12 that the value of the drain current of the transistor 15 is larger than a desired value, the image processing circuit 13 corrects the image signal so as to decrease the drain current of the transistor 15. Conversely, in the case where it is determined from the signal generated by the monitor circuit 12 that the value of the drain current of the transistor 15 is smaller than the desired value, the image processing circuit 13 corrects the image signal so as to increase the drain current of the transistor 15.

The correction of the image signal makes it possible to correct not only variation in threshold voltage of the transistor 15 among pixels 11 but also variation in other electrical characteristics, such as mobility, of the transistor 15. Thus, variation in luminance of the light-emitting element 14 among pixels 11 can be further suppressed as compared with the case where threshold voltage correction is performed inside the pixels 11.

In the case where the correction of the image signal is performed, the drain current is extracted from the pixel 11 through the switch 17, and in the case where the correction of the image signal is not performed, the drain current is supplied to the light-emitting element 14 through the switch 16. That is, in one embodiment of the present invention, a flow path of the drain current can be changed by choosing whether to turn on or off the switch 16 and the switch 17, i.e., by switching. Thus, even when a plurality of wirings VL connected to a plurality of pixels 11 are electrically connected to each other, extraction of drain current from a selected pixel 11 and display at a grayscale level based on an image signal by pixels 11 other than the selected pixel 11 can be performed in parallel. Accordingly, in one embodiment of the present invention, image display and the correction of the image signal can be performed in parallel. Therefore, it is not necessary to perform the correction of the image signal in a specific short period which is not involved in image display, and it is possible to reduce a load on a driver circuit which controls the correction of the image signal.

Note that in one embodiment of the present invention, it is also possible to correct the threshold voltage of the transistor 15 inside the pixel 11 by turning on the switch 17 to change the potential of the wiring ML before determining the value of the drain current of the transistor 15 in accordance with the image signal. Alternatively, it is possible to correct the threshold voltage of the transistor 15 inside the pixel 11 by providing the pixel 11 illustrated in FIG. 1 with a configuration capable of supplying a potential to the one of the source and the drain of the transistor 15 through a switch.

Even in the case where threshold voltage correction inside the pixel 11 (hereinafter referred to as internal correction) is not performed and image signal correction by the image processing circuit 13 (hereinafter referred to as external correction) is performed, it is possible to correct not only variation in threshold voltage of the transistor 15 among the pixels 11 but also variation in electrical characteristics other than threshold voltage, such as mobility, of the transistor 15. Note that in the case where internal correction is performed in addition to external correction, a negative shift or a positive shift of the threshold voltage is corrected by the internal correction. Thus, external correction may be performed to correct variation in electrical characteristics other than threshold voltage, such as mobility, of the transistor 15. Therefore, in the case where internal correction is performed in addition to external correction, the potential amplitude of a corrected image signal can be made smaller than in the case where only the external correction is performed. This can prevent a situation where the potential amplitude of the image signal is so large that there are large differences in potential of the image signal between different grayscale levels and it is difficult to express minute gradations of an image with luminance differences. Thus, a decrease in image quality can be prevented.

Specific Configuration Example of Light-Emitting Device

Figure 2:
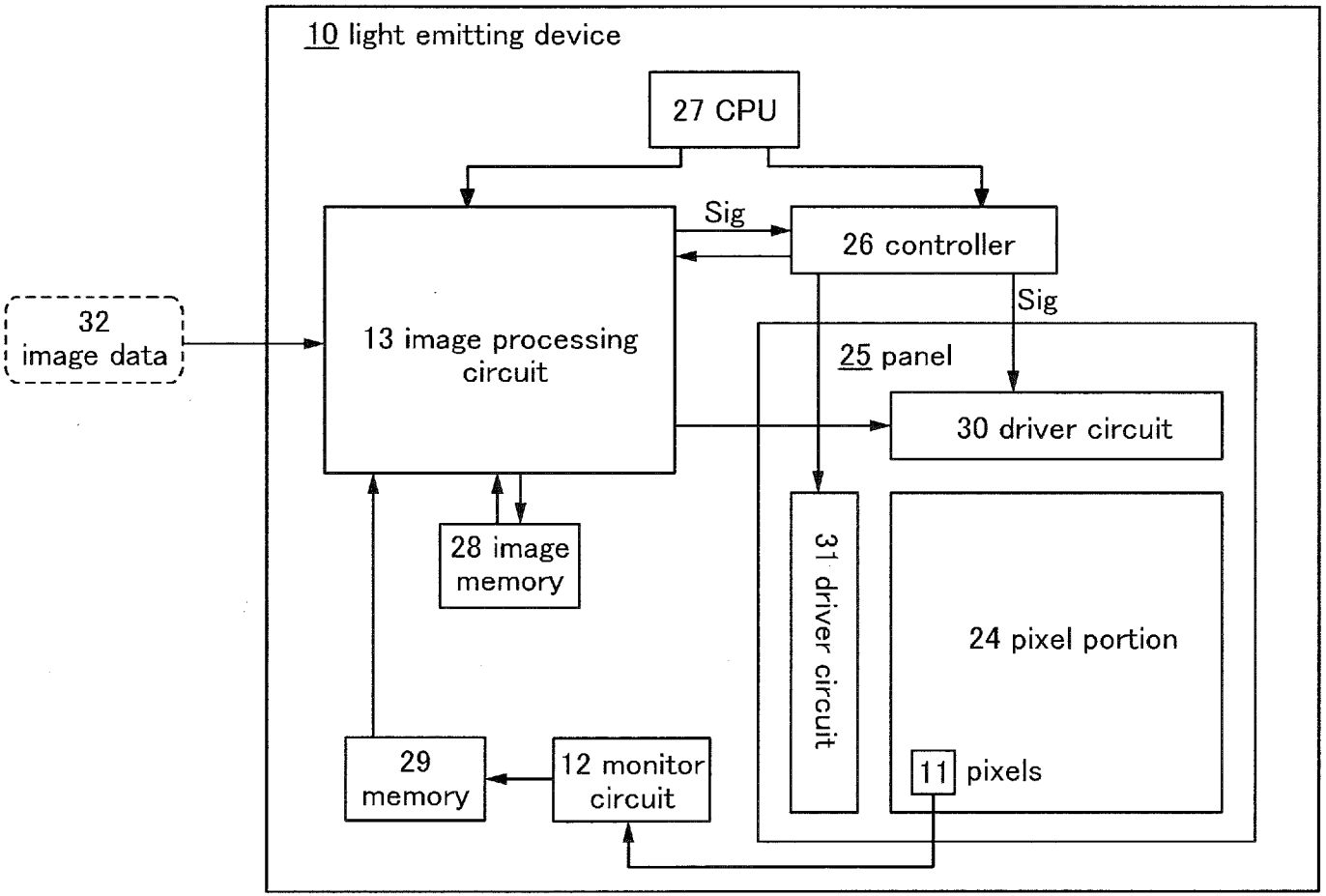
FIG. 2 illustrates a specific configuration example of a light-emitting device.

Next, an example of a more detailed configuration of the light-emitting device 10 illustrated in FIG. 1 is described. FIG. 2 is a block diagram illustrating, as an example, a configuration of the light-emitting device 10 of one embodiment of the present invention. Although the block diagram shows elements classified according to their functions in independent blocks, it may be practically difficult to completely separate the elements according to their functions and, in some cases, one element may be involved in a plurality of functions.

The light-emitting device 10 illustrated in FIG. 2 includes a panel 25 including a plurality of pixels 11 in a pixel portion 24, a controller 26, a CPU 27, the image processing circuit 13, an image memory 28, a memory 29, and the monitor circuit 12. In addition, the light-emitting device 10 illustrated in FIG. 2 includes a driver circuit 30 and a driver circuit 31 in the panel 25.

The CPU 27 has a function of decoding an instruction input from the outside or an instruction stored in a memory provided in the CPU 27 and executing the instruction by controlling the overall operations of various circuits included in the light-emitting device 10.

The monitor circuit 12 generates a signal including information about the value of the drain current from the drain current which is extracted from the pixel 11. The memory 29 has a function of storing the information included in the signal.

The image memory 28 has a function of storing image data 32 which is input to the light-emitting device 10. Note that although only one image memory 28 is provided in the light-emitting device 10 in FIG. 2, a plurality of image memories 28 may be provided in the light-emitting device 10. For example, in the case where the pixel portion 24 displays a full-color image with the use of three pieces of image data 32 corresponding to hues such as red, blue, and green, respective image memories 28 corresponding to the pieces of image data 32 may be provided.

As the image memory 28, for example, a memory circuit such as a dynamic random access memory (DRAM) or a static random access memory (SRAM) can be used. Alternatively, a video RAM (VRAM) may be used as the image memory 28.

The image processing circuit 13 has a function of writing and reading the image data 32 to and from the image memory 28 in response to an instruction from the CPU 27 and generating an image signal Sig from the image data 32. In addition, the image processing circuit 13 has a function of reading the information stored in the memory 29 in response to an instruction from the CPU 27 and correcting the image signal using the information.

The controller 26 has a function of processing the image signal Sig which includes image information and is input to the controller 26, in accordance with the specification of the panel 25 and then supplying the processed image signal Sig to the panel 25.

The driver circuit 31 has a function of selecting a plurality of pixels 11 included in the pixel portion 24 row by row. The driver circuit 30 has a function of supplying the image signal Sig supplied from the controller 26 to the pixels 11 in a row selected by the driver circuit 31.

Note that the controller 26 has a function of supplying various driving signals used for driving the driver circuit 30, the driver circuit 31, and the like to the panel 25. The driving signals include a start pulse signal SSP and a clock signal SCK which control the operation of the driver circuit 30, a latch signal LP, a start pulse signal GSP and a clock signal GCK which control the operation of the driver circuit 31, and the like.

Note that the light-emitting device 10 may include an input device having a function of supplying information or an instruction to the CPU 27 included in the light-emitting device 10. As the input device, a keyboard, a pointing device, a touch panel, a sensor, or the like can be used.

Configuration Example 1 of Pixel

Next, a specific configuration example of the pixel 11 included in the light-emitting device 10 illustrated in FIG. 1 is described.

Figure 3:
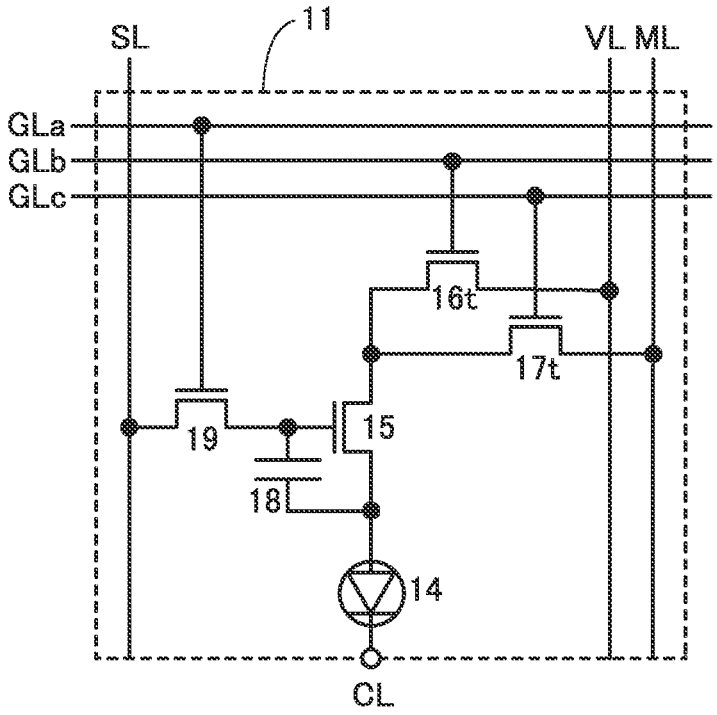
FIG. 3 illustrates a configuration example of a pixel.

FIG. 3 illustrates an example of a circuit diagram of the pixel 11. The pixel 11 includes the transistor 15, a transistor 16*t* serving as the switch 16, a transistor 17*t* serving as the switch 17, the capacitor 18, the light-emitting element 14, and a transistor 19.

The potential of a pixel electrode of the light-emitting element 14 is controlled by the image signal Sig which is input to the pixel 11. The luminance of the light-emitting element 14 is determined by a potential difference between the pixel electrode and a common electrode. For example, in the case where an OLED is used as the light-emitting element 14, one of the anode and the cathode serves as the pixel electrode and the other thereof serves as the common electrode. FIG. 3 illustrates a configuration of the pixel 11 in which the anode of the light-emitting element 14 is used as the pixel electrode and the cathode of the light-emitting element 14 is used as the common electrode.

The transistor 19 has a function of controlling electrical connection between the wiring SL and the gate of the transistor 15. One of the source and the drain of the transistor 15 is connected to the anode of the light-emitting element 14. The transistor 16*t* has a function of controlling electrical connection between the wiring VL and the other of the source and the drain of the transistor 15. The transistor 17*t* has a function of controlling electrical connection between the wiring ML and the other of the source and the drain of the transistor 15. One of a pair of electrodes of the capacitor 18 is connected to the gate of the transistor 15, and the other is connected to the anode of the light-emitting element 14.

The switching of the transistor 19 is performed in accordance with the potential of a wiring GLa connected to a gate of the transistor 19. The switching of the transistor 16*t* is performed in accordance with the potential of a wiring GLb connected to a gate of the transistor 16*t*. The switching of the transistor 17*t* is performed in accordance with the potential of a wiring GLc connected to a gate of the transistor 17*t*.

In the transistors included in the pixel 11, an oxide semiconductor or an amorphous, microcrystalline, polycrystalline, or single crystal semiconductor can be used. As a material of such a semiconductor, silicon, germanium, or the like can be given. When the transistor 19 includes an oxide semiconductor in a channel formation region, the off-state current of the transistor 19 can be extremely low. Furthermore, when the transistor 19 having the above-described structure is used in the pixel 11, leakage of electric charge accumulated in the gate of the transistor 15 can be prevented effectively as compared with the case where a transistor including a normal semiconductor such as silicon or germanium is used as the transistor 19.

Accordingly, for example, in the case where image signals Sig each having the same image information are written to the pixel portion for some consecutive frame periods as in the case of displaying a still image, display of an image can be maintained even when driving frequency is low, in other words, the number of operations of writing image signals Sig to the pixel portion for a certain period is reduced. For example, by using a highly purified oxide semiconductor for a semiconductor film of the transistor 19, the interval between the operations of writing image signals Sig can be 10 seconds or longer, preferably 30 seconds or longer, more preferably 1 minute or longer. As the interval between the operations of writing image signals Sig increases, power consumption can be further reduced.

In addition, since the potential of the image signal Sig can be held for a longer period, the quality of an image to be displayed can be prevented from being lowered even when the capacitor 18 for holding the potential of the gate of the transistor 15 is not provided in the pixel 11. Thus, it is possible to increase the aperture ratio of the pixel 11 by reducing the size of the capacitor 18 or without providing the capacitor 18. Accordingly, the light-emitting element 14 with long lifetime can be obtained, whereby the reliability of the light-emitting device 10 can be increased.

Note that in FIG. 3, the pixel 11 may further include another circuit element such as a transistor, a diode, a resistor, a capacitor, or an inductor as needed.

In FIG. 3, the transistors each have the gate on at least one side of a semiconductor film; alternatively, the transistors may each have a pair of gates with a semiconductor film positioned therebetween. When one of the pair of gates is regarded as a back gate, potentials at the same level may be applied to a normal gate and the back gate, or a fixed potential such as a ground potential may be applied only to the back gate. By controlling the level of the potential applied to the back gate, the threshold voltage of the transistor can be controlled. By providing the back gate, a channel formation region is enlarged and the drain current can be increased. Moreover, providing the back gate facilitates formation of a depletion layer in the semiconductor film, which results in lower subthreshold swing.

The transistors in FIG. 3 are all n-channel transistors. When the transistors in the pixel 11 have the same channel type, it is possible to omit some of steps for fabricating the transistors, for example, a step of adding an impurity element imparting one conductivity type to the semiconductor film. Note that in the light-emitting device according to one embodiment of the present invention, not all the transistors in the pixel 11 are necessarily n-channel transistors. In the case where the cathode of the light-emitting element 14 is connected to the wiring CL, it is preferable that at least the transistor 15 be an n-channel transistor. In the case where the anode of the light-emitting element 14 is connected to the wiring CL, it is preferable that at least the transistor 15 be a p-channel transistor.

FIG. 3 illustrates the case where the transistors in the pixel 11 have a single-gate structure including one gate and one channel formation region; however, one embodiment of the present invention is not limited to this structure. Any or all of the transistors in the pixel 11 may have a multi-gate structure including a plurality of gates electrically connected to each other and a plurality of channel formation regions.

Example 1 of Operation for External Correction

Next, an example of operation of the pixel 11 illustrated in FIG. 3 for external correction is described.

Figure 4:
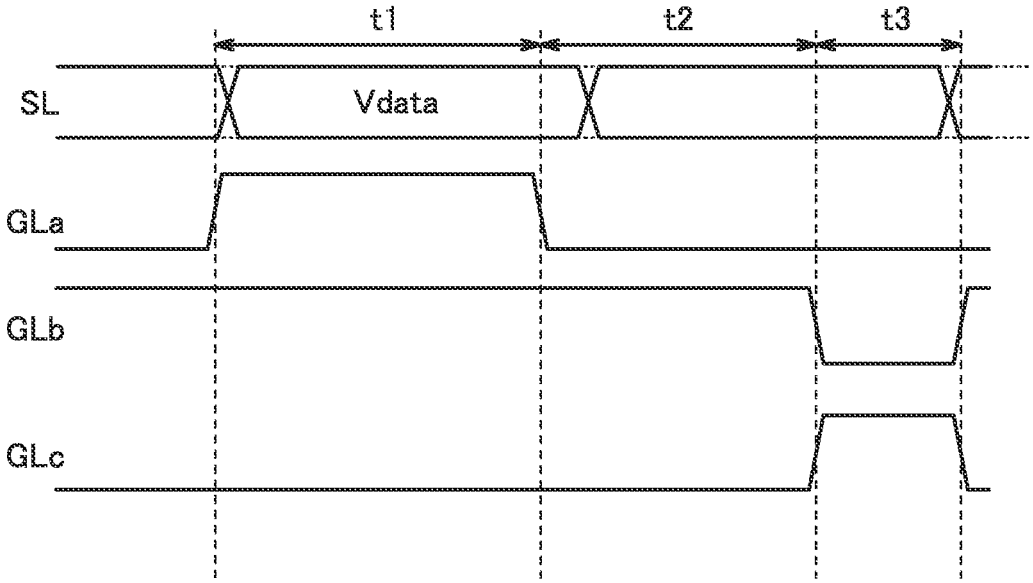
FIG. 4 is a timing chart for a pixel.
Figure 5A:
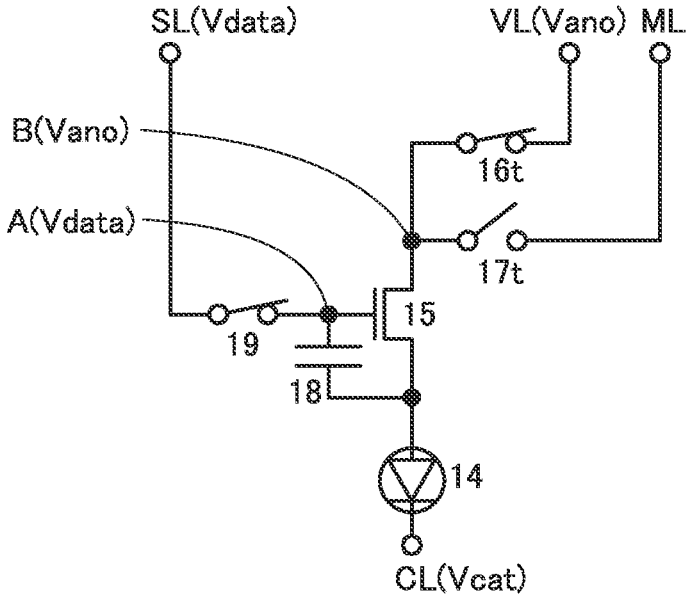
FIGS. 5A and 5B schematically illustrate the operation of a pixel.
Figure 5B:
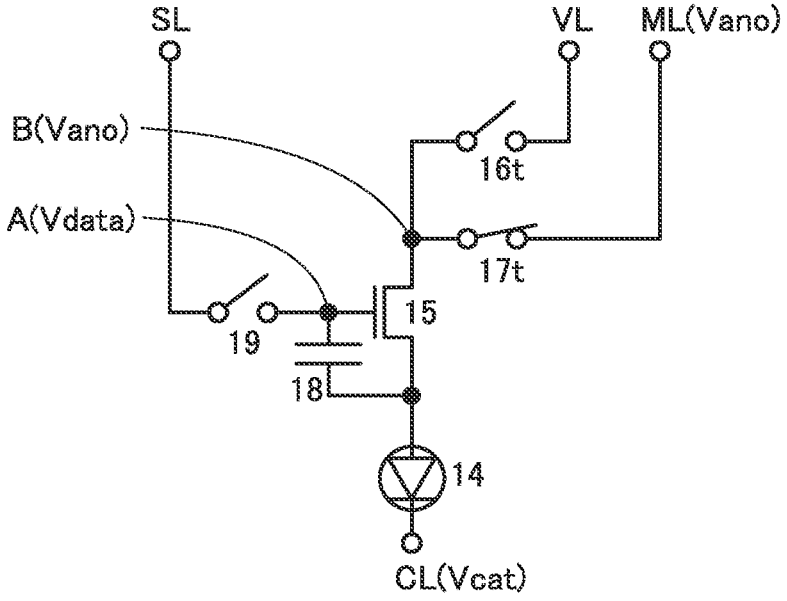

FIG. 4 is a timing chart of potentials of the wiring GLa, the wiring GLb, and the wiring GLc, which are connected to the pixel 11 illustrated in FIG. 3, and a potential of the image signal Sig supplied to the wiring SL. Note that the timing chart shown in FIG. 4 is an example in which all the transistors included in the pixel 11 illustrated in FIG. 3 are n-channel transistors. FIGS. 5A and 5B schematically illustrate the operation of the pixel 11 in different periods. Note that in FIGS. 5A and 5B, the transistors other than the transistor 15 are illustrated as switches for easy understanding of the operation of the pixel 11.

First, in a period t1, a high-level potential is applied to the wiring GLa, a high-level potential is applied to the wiring GLb, and a low-level potential is applied to the wiring GLc. Accordingly, as illustrated in FIG. 5A, the transistor 19 and the transistor 16*t* are turned on, and the transistor 17*t* is turned off. A potential Vdata of the image signal Sig is applied to the wiring SL, and the potential Vdata is applied to the gate of the transistor 15 (indicated as a node A in the diagrams) through the transistor 19.

A potential Vano is applied to the wiring VL, and a potential Vcat is applied to the wiring CL. The potential Vano is preferably higher than the sum of the potential Vcat and the threshold voltage Vthe of the light-emitting element 14. The potential Vano of the wiring VL is applied to the other of the source and the drain of the transistor 15 (indicated as a node B in the diagrams) through the transistor 16*t*. Thus, the value of the drain current of the transistor 15 is determined by the potential Vdata. Then, the drain current is supplied to the light-emitting element 14, whereby the luminance of the light-emitting element 14 is determined.

Next, in a period t2, a low-level potential is applied to the wiring GLa, the high-level potential is applied to the wiring GLb, and the low-level potential is applied to the wiring GLc. Accordingly, the transistor 16*t* is turned on, and the transistor 19 and the transistor 17*t* are turned off. Since the transistor 19 is off, the potential Vdata is held at the gate of the transistor 15. The potential Vano is applied to the wiring VL, and the potential Vcat is applied to the wiring CL. Thus, the light-emitting element 14 maintains the luminance determined in the period t1.

Next, in a period t3, the low-level potential is applied to the wiring GLa, a low-level potential is applied to the wiring GLb, and a high-level potential is applied to the wiring GLc. Accordingly, as illustrated in FIG. 5B, the transistor 17*t* is turned on, and the transistor 19 and the transistor 16*t* are turned off. The potential Vcat is applied to the wiring CL. The potential Vano is applied to the wiring ML, which is connected to the monitor circuit.

By the above operation, the drain current of the transistor 15 is supplied to the light-emitting element 14 through the transistor 17*t*. In addition, the drain current is also supplied to the monitor circuit through the wiring ML. The monitor circuit generates a signal including information about the value of the drain current by using the drain current flowing through the wiring ML. Thus, using the above signal, the light-emitting device according to one embodiment of the present invention can correct the value of the potential Vdata of the image signal Sig supplied to the pixel 11.

Note that in the light-emitting device including the pixel 11 illustrated in FIG. 3, the operation in the period t3 is not necessarily performed after the operation in the period t2. For example, in the light-emitting device, the operation in the period t3 may be performed after the operations in the periods t1 and t2 are repeated a plurality of times. Alternatively, after the operation in the period t3 is performed on pixels 11 in one row, the light-emitting elements 14 may be brought into a non-light-emitting state by writing an image signal corresponding to the lowest grayscale level 0 to the pixels 11 in the row which have been subjected to the above operation. Then, the operation in the period t3 may be performed on pixels 11 in the next row.

Example 1 of Operation for External and Internal Corrections

Next, an example of operation of the pixel 11 illustrated in FIG. 3 for internal and external corrections is described.

Figure 6:
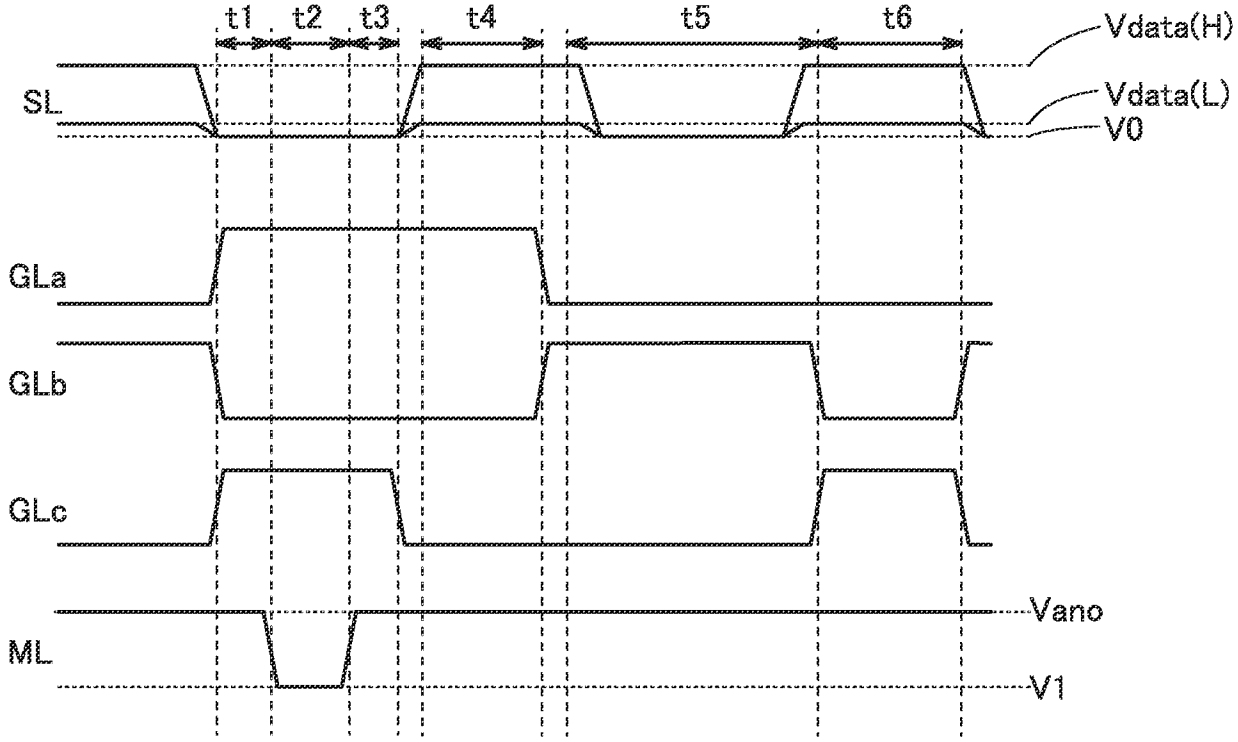
FIG. 6 is a timing chart for a pixel.

FIG. 6 is a timing chart of potentials of the wiring GLa, the wiring GLb, and the wiring GLc, which are connected to the pixel 11 illustrated in FIG. 3, a potential applied to the wiring SL, and a potential applied to the wiring ML. Note that the timing chart shown in FIG. 6 is an example in which all the transistors included in the pixel 11 illustrated in FIG. 3 are n-channel transistors. FIGS. 7A and 7B, FIGS. 8A and 8B, and FIGS. 9A and 9B schematically illustrate the operation of the pixel 11 in respective periods. Note that in FIGS. 7A and 7B, the transistors other than the transistor 15 are illustrated as switches for easy understanding of the operation of the pixel 11.

Figure 7A:
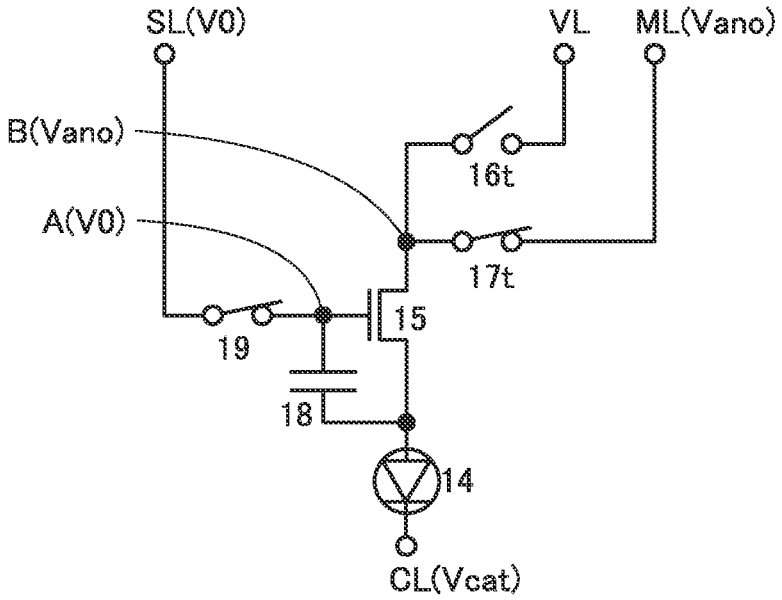
FIGS. 7A and 7B schematically illustrate the operation of a pixel.

First, in a period t1, a high-level potential is applied to the wiring GLa, a low-level potential is applied to the wiring GLb, and a high-level potential is applied to the wiring GLc. Accordingly, as illustrated in FIG. 7A, the transistor 19 and the transistor 17*t* are turned on, and the transistor 6*t* is turned off. A potential Vano is applied to the wiring ML, a potential Vcat is applied to the wiring CL, and a potential V0 is applied to the wiring SL. The potential V0 of the wiring SL is applied to the gate of the transistor 15 (the node A) through the transistor 19, and the potential Vano of the wiring ML is applied to the other of the source and the drain of the transistor 15 (the node B).

It is preferable that the potential V0 be lower than a potential obtained by adding the threshold voltage Vthe of the light-emitting element 14 and the threshold voltage Vth of the transistor 15 to the potential Vcat. With the potential V0 set in the above range, the transistor 15 is turned off in the period t1, so that current can be prevented from flowing to the light-emitting element 14.

Figure 7B:
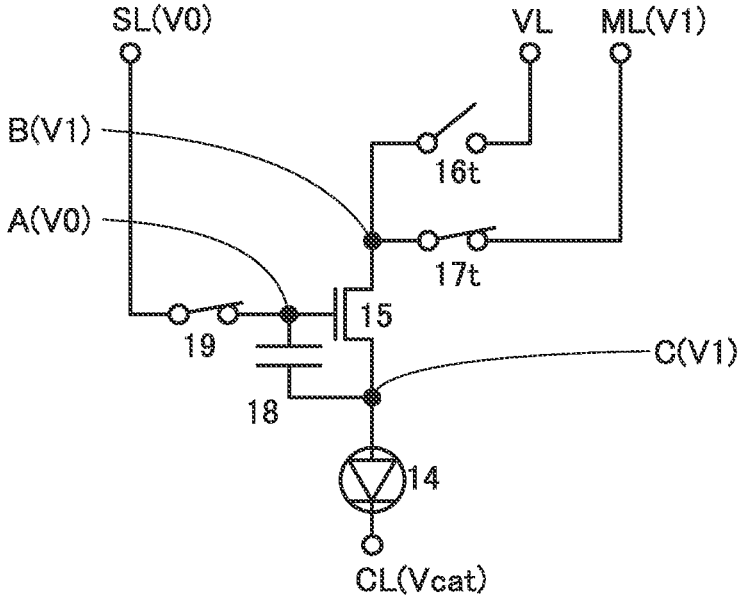

Next, in a period t2, the high-level potential is applied to the wiring GLa, the low-level potential is applied to the wiring GLb, and the high-level potential is applied to the wiring GLc. Accordingly, as illustrated in FIG. 7B, the transistor 19 and the transistor 17*t* are turned on, and the transistor 16*t* is turned off. A potential V1 is applied to the wiring ML, the potential Vcat is applied to the wiring CL, and the potential V0 is applied to the wiring SL. The potential V0 of the wiring SL is applied to the gate of the transistor 15 through the transistor 19, and the potential V1 of the wiring ML is applied to the other of the source and the drain of the transistor 15.

It is preferable that the potential V1 be sufficiently lower than a potential obtained by subtracting the threshold voltage Vth of the transistor 15 from the potential V0. With the above configuration, the transistor 15 is turned on, so that the potential V1 of the wiring ML is applied to the one of the source and the drain of the transistor 15 (indicated as a node C in the diagrams).

Note that the light-emitting element 14 does not emit light in the period t2 because the potential V1 can be set sufficiently lower than the sum of the potential Vcat and the threshold voltage Vthe of the light-emitting element 14.

Figure 8A:
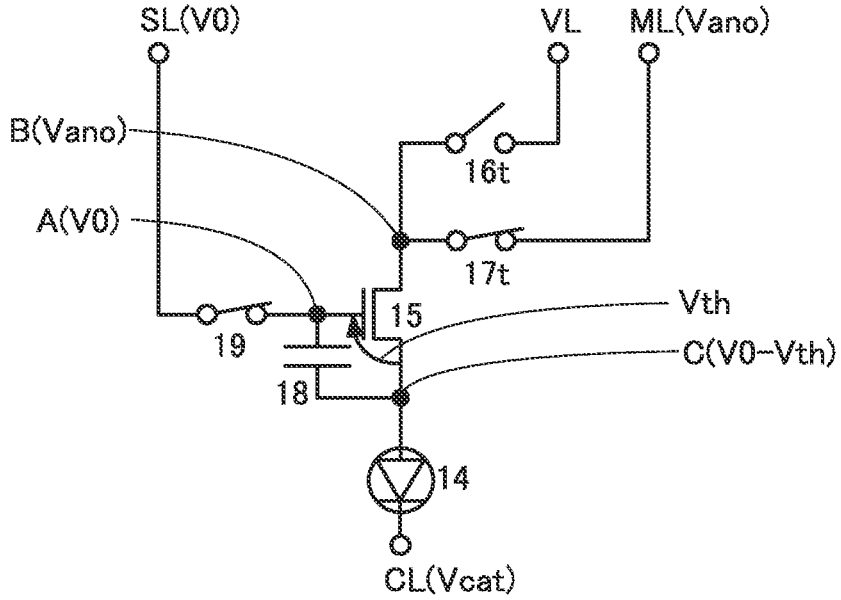
FIGS. 8A and 8B schematically illustrate the operation of a pixel.

Next, in a period t3, the high-level potential is applied to the wiring GLa, the low-level potential is applied to the wiring GLb, and the high-level potential is applied to the wiring GLc. Accordingly, as illustrated in FIG. 8A, the transistor 19 and the transistor 17*t* are turned on, and the transistor 16*t* is turned off. The potential Vano is applied to the wiring ML, the potential Vcat is applied to the wiring CL, and the potential V0 is applied to the wiring SL. The potential V0 of the wiring SL is applied to the gate of the transistor 15 through the transistor 19, and the potential Vano of the wiring ML is applied to the other of the source and the drain of the transistor 15.

At the start of the period t3, since the transistor 15 is in an on state and the potential Vano of the wiring ML is applied to the other of the source and the drain of the transistor 15, charge in the capacitor 18 is released through the transistor 15. The potential of the one of the source and the drain of the transistor 15 (the node C) starts to increase from the potential V1 and eventually converges to a potential V0−Vth. Accordingly the transistor 15 is turned off, so that the capacitor 18 acquires the threshold voltage Vth.

Note that the light-emitting element 14 does not emit light in the period t3 because the potential of the one of the source and the drain of the transistor 15 (the node C) is the potential V0−Vth and is lower than the sum of the potential Vcat and the threshold voltage Vthe of the light-emitting element 14.

Figure 8B:
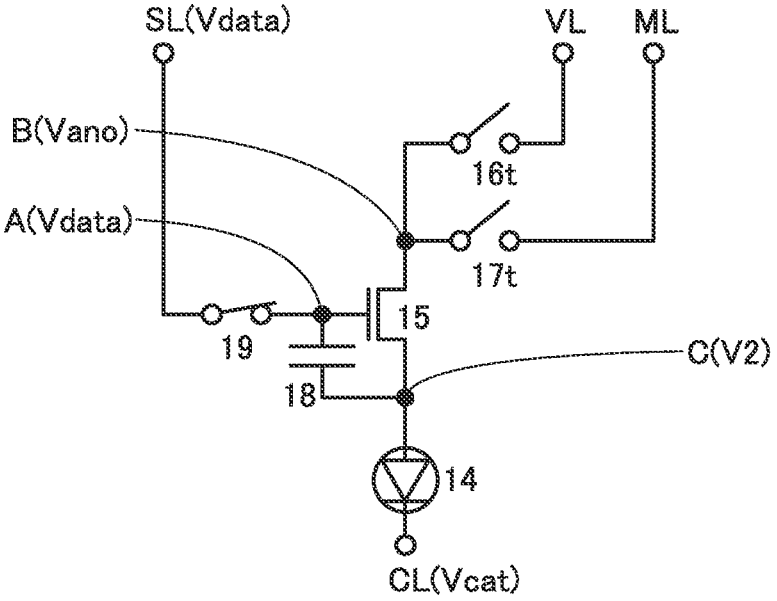

Next, in a period t4, the high-level potential is applied to the wiring GLa, the low-level potential is applied to the wiring GLb, and a low-level potential is applied to the wiring GLc. Accordingly, as illustrated in FIG. 8B, the transistor 19 is turned on, and the transistor 16*t* and the transistor 17*t* are turned off. The potential Vcat is applied to the wiring CL, and a potential Vdata of an image signal Sig is applied to the wiring SL. Note that although FIG. 6 illustrates the case where the potential Vano is applied to the wiring ML in the period t4, a potential other than the potential Vano may be applied to the wiring ML in the period t4.

The potential Vdata applied to the wiring SL is applied to the gate of the transistor 15 (the node A) through the transistor 19. Note that the level of the potential Vdata is varied depending on image information included in the image signal Sig. FIG. 6 illustrates both the case where a high-level potential Vdata(H) is applied to the wiring SL in the period t4 and the case where a low-level potential Vdata(L) is applied thereto.

A potential V2 of the one of the source and the drain of the transistor 15 (the node C) at the end of the period t4 is described below.

Figure 10A:
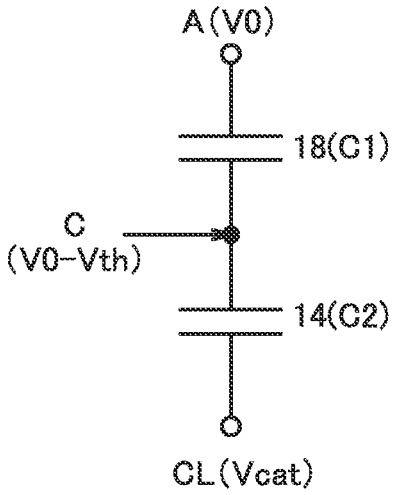
FIGS. 10A and 10B each schematically illustrate a state where a capacitor and a light-emitting element are connected in series to each other.
Figure 10B:
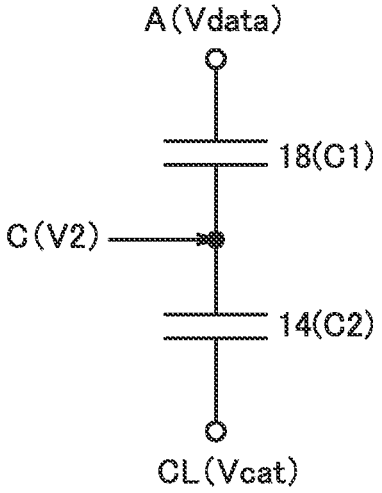

The pixel 11 illustrated in FIG. 3 has a configuration in which the capacitor 18 and the light-emitting element 14 are connected to each other in series. FIGS. 10A and 10B each schematically illustrate a state where the capacitor 18 and the light-emitting element 14 are connected in series to each other. In each of FIGS. 10A and 10B, the light-emitting element 14 is illustrated as one capacitor. FIG. 10A corresponds to the end of the period t3, and FIG. 10B corresponds to the end of the period t4.

As illustrated in FIG. 10A, at the end of the period t3, the potential V0 is applied to the gate of the transistor 15 (the node A), the potential of the one of the source and the drain of the transistor 15 (the node C) is the potential V0−Vth, and the potential Vcat is applied to the wiring CL. As illustrated in FIG. 10B, at the end of the period t4, in the case where the transistor 15 is turned off and the potential Vdata is applied to the node A, the potential V2 of the node C is determined by the ratio of a capacitance C1 of the capacitor 18 to a capacitance C2 of the light-emitting element 14.

Note that the transistor 15 is turned on in the period t4 depending on the level of the potential Vdata. In the case where the transistor 15 is turned on in the period t4, charge flows into the node C through the transistor 15; therefore, the potential V2 of the node C is not determined by the ratio of the capacitance C1 of the capacitor 18 to the capacitance C2 of the light-emitting element 14 alone, and the value thereof changes depending on the amount of charge flowing into the node C.

Specifically, when the potential of the node C at the end of the period t4 is the potential V2, the voltage of the node A with respect to the node C, i.e., the gate voltage Vgs of the transistor 15, in the period t4 is represented by Formula 1. Note that Q1 refers to the amount of charge flowing into the node C.

$$Vgs=V\text{data}-V2=C2(V\text{data}-V0)/(C1+C2)+V\text{th}-Q1/(C1+C2) \quad \text{(Formula 1)}$$

Note that an ideal gate voltage Vgs at the end of the period t4 is Vdata−V0+Vth. When the gate voltage Vgs has this value, even when the threshold voltages Vth of the transistors 15 vary, the variation does not influence the drain current of the transistors 15. In order to make the gate voltage Vgs close to the ideal voltage, it is found preferable from Formula 1 that C2/(C1+C2) be close to 1. In other words, it is preferable that the capacitance C2 of the light-emitting element 14 be sufficiently larger than the capacitance C1 of the capacitor 18 because the gate voltage Vgs can be made close to the ideal value.

Furthermore, in order to make the gate voltage Vgs close to the ideal value, it is found preferable from Formula 1 that Q1/(C1+C2) be small. In other words, it is preferable that the amount Q1 of charge flowing into the node C be made small in order to make the gate voltage Vgs close to the ideal value. Accordingly, the period t4 is preferably as short as possible in order to make the amount Q1 of charge small.

Note that, in the light-emitting device including the pixel 11 illustrated in FIG. 3, the other of the source and the drain of the transistor 15 is electrically isolated from the gate of the transistor 15, so that their potentials can be individually controlled. Accordingly, in the period t3, the potential of the other of the source and the drain of the transistor 15 can be set higher than a potential obtained by adding the threshold voltage Vth to the potential of the gate of the transistor 15. Therefore, in the case where the transistor 15 is a normally-on transistor, in other words, in the case where the threshold voltage Vth is negative, charge can be accumulated in the capacitor 18 until the potential of the source of the transistor 15 becomes higher than the potential V0 of the gate. Accordingly, in the light-emitting device according to one embodiment of the present invention, even when the transistor 15 is a normally-on transistor, the capacitor 18 acquires the threshold voltage in the period t3, and in the period t3, the gate voltage Vgs of the transistor 15 can be set to a value obtained by taking the threshold voltage Vth into account.

Thus, in the light-emitting device according to one embodiment of the present invention, for example, in the case where an oxide semiconductor is used for the semiconductor film of the transistor 15, even when the transistor 15 is a normally-on transistor, display unevenness can be reduced and a high-quality image can be displayed.

The gate voltage Vgs set in the period t4 is held by the capacitor 18.

Figure 9A:
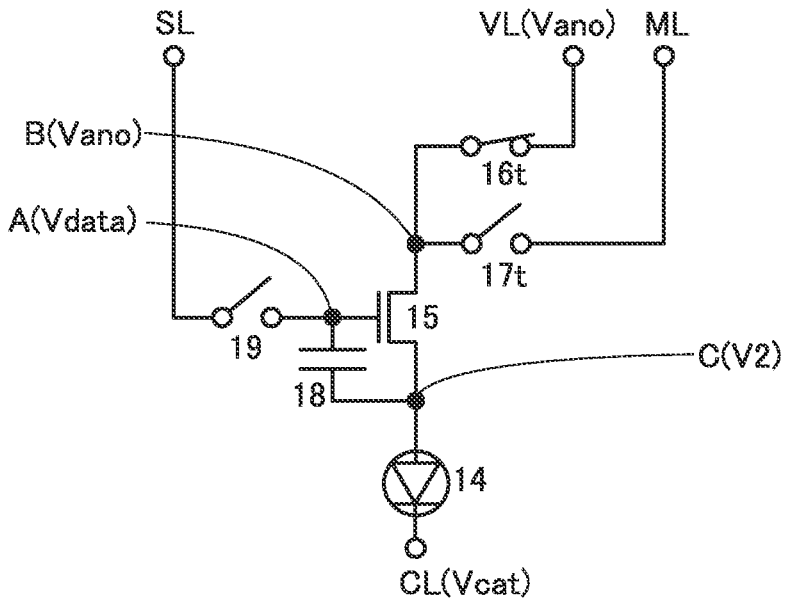
FIGS. 9A and 9B schematically illustrate the operation of a pixel.

Next, in a period t5, a low-level potential is applied to the wiring GLa, a high-level potential is applied to the wiring GLb, and the low-level potential is applied to the wiring GLc. Accordingly, as illustrated in FIG. 9A, the transistor 16*t* is turned on, and the transistor 19 and the transistor 17*t* are turned off. When the transistor 19 is off, the potential Vdata is held at the gate of the transistor 15. The potential Vano is applied to the wiring VL, and the potential Vcat is applied to the wiring CL. Thus, the light-emitting element 14 maintains the luminance determined in the period t4.

Note that although FIG. 6 illustrates the case where the potential Vano is applied to the wiring ML in the period t5, a potential other than the potential Vano may be applied to the wiring ML in the period t5.

Figure 9B:
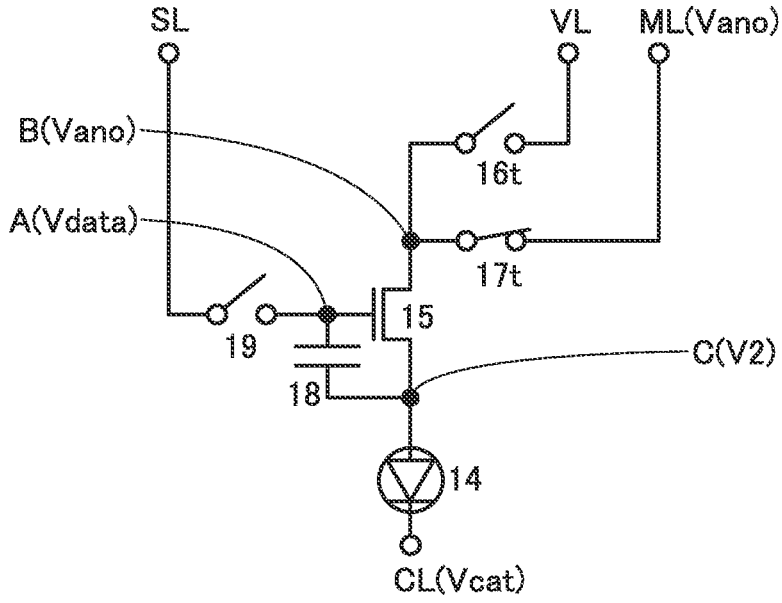

Next, in a period t6, the low-level potential is applied to the wiring GLa, the low-level potential is applied to the wiring GLb, and the high-level potential is applied to the wiring GLc. Accordingly, as illustrated in FIG. 9B, the transistor 17*t* is turned on, and the transistor 19 and the transistor 16*t* are turned off. The potential Vcat is applied to the wiring CL. The potential Vano is applied to the wiring ML, which is connected to the monitor circuit.

By the above operation, the drain current of the transistor 15 is supplied to the light-emitting element 14 through the transistor 17*t*. In addition, the drain current is also supplied to the monitor circuit through the wiring ML. The monitor circuit generates a signal including information about the value of the drain current by using the drain current flowing through the wiring ML. Thus, using the above signal, the light-emitting device according to one embodiment of the present invention can correct the value of the potential Vdata of the image signal Sig supplied to the pixel 11.

Note that in the light-emitting device including the pixel 11 illustrated in FIG. 3, the operation in the period t6 is not necessarily performed after the operation in the period t5. For example, in the light-emitting device, the operation in the period t6 may be performed after the operations in the periods t1 to t5 are repeated a plurality of times. Alternatively, after the operation in the period t6 is performed on pixels 11 in one row, the light-emitting elements 14 may be brought into a non-light-emitting state by writing an image signal corresponding to the lowest grayscale level 0 to the pixels 11 in the row which have been subjected to the above operation. Then, the operation in the period t6 may be performed on pixels 11 in the next row.

Configuration Example 2 of Pixel

Next, a configuration example of the pixel 11 included in the light-emitting device 10 illustrated in FIG. 1, which is different from that in FIG. 3, is described.

Figure 11:
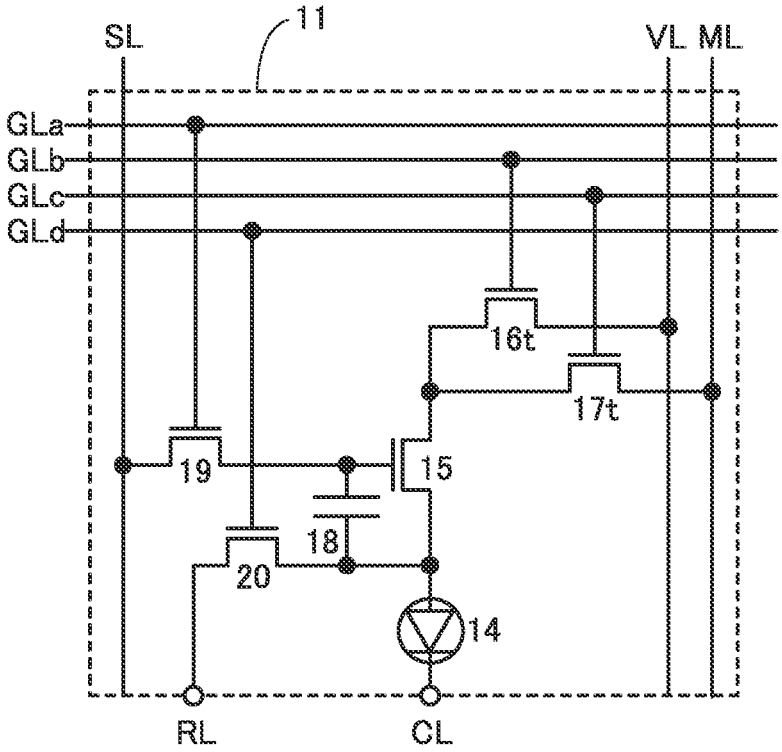
FIG. 11 illustrates a configuration example of a pixel.

FIG. 11 illustrates an example of a circuit diagram of the pixel 11. The pixel 11 illustrated in FIG. 11 differs from the pixel 11 illustrated in FIG. 3 in including a transistor 20 in addition to the transistor 15, the transistor 16*t* serving as the switch 16, the transistor 17*t* serving as the switch 17, the capacitor 18, the light-emitting element 14, and the transistor 19.

The transistor 20 has a function of controlling electrical connection between a wiring RL and the anode of the light-emitting element 14. The switching of the transistor 20 is performed in accordance with the potential of a wiring GLd connected to a gate of the transistor 20.

Note that in FIG. 11, the pixel 11 may further include another circuit element such as a transistor, a diode, a resistor, a capacitor, or an inductor as needed.

Example 2 of Operation for External Correction

Next, an example of operation of the pixel 11 illustrated in FIG. 11 for external correction is described.

Figure 12:
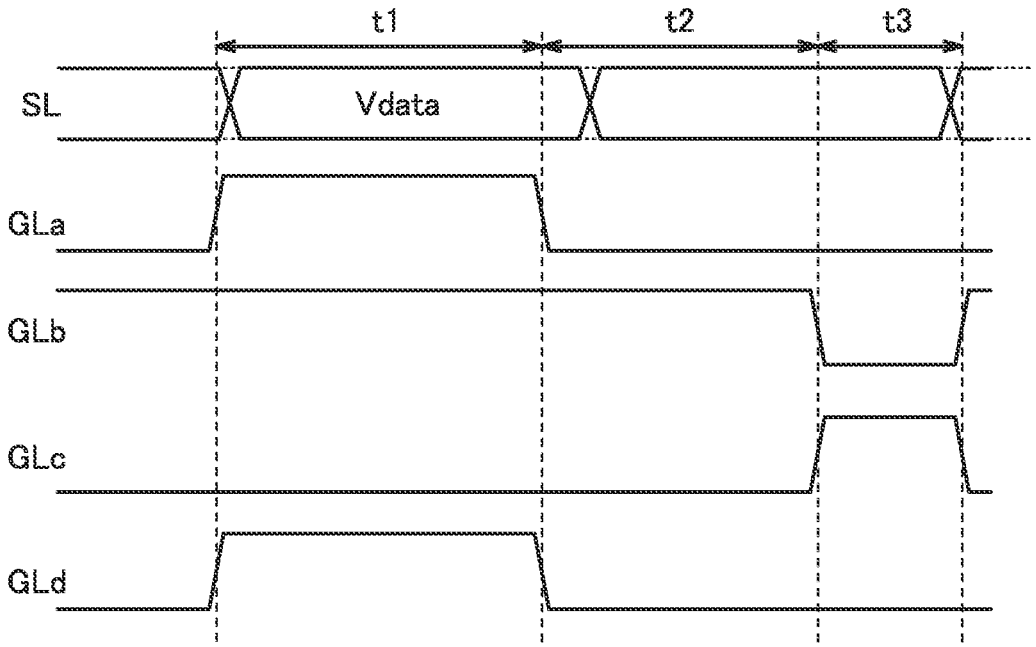
FIG. 12 is a timing chart for a pixel.
Figure 13A:
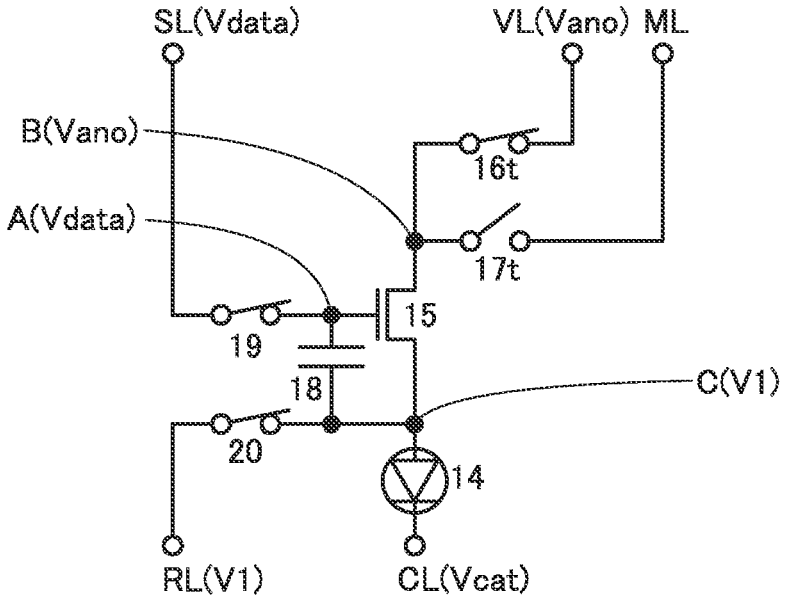
FIGS. 13A and 13B schematically illustrate the operation of a pixel.
Figure 13B:
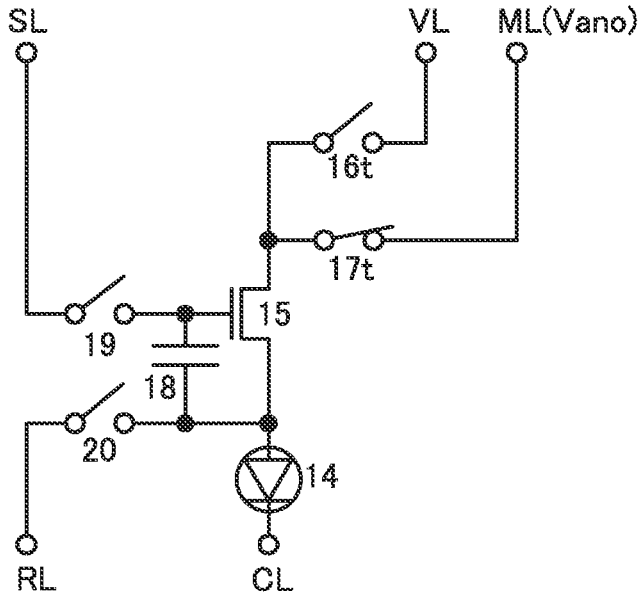

FIG. 12 is a timing chart of potentials of the wiring GLa, the wiring GLb, the wiring GLc, and the wiring GLd, which are connected to the pixel 11 illustrated in FIG. 11, and a potential of the image signal Sig supplied to the wiring SL. Note that the timing chart shown in FIG. 12 is an example in which all the transistors included in the pixel 11 illustrated in FIG. 11 are n-channel transistors. FIGS. 13A and 13B schematically illustrate the operation of the pixel 11 in different periods. Note that in FIGS. 13A and 13B, the transistors other than the transistor 15 are illustrated as switches for easy understanding of the operation of the pixel 11.

First, in a period t1, a high-level potential is applied to the wiring GLa, a high-level potential is applied to the wiring GLb, a low-level potential is applied to the wiring GLc, and a high-level potential is applied to the wiring GLd. Accordingly, as illustrated in FIG. 13A, the transistor 19, the transistor 16*t*, and the transistor 20 are turned on, and the transistor 17*t* is turned off. A potential Vdata of the image signal Sig is applied to the wiring SL, and the potential Vdata is applied to the gate of the transistor 15 (the node A) through the transistor 19. Thus, the value of the drain current of the transistor 15 is determined by the potential Vdata. A potential Vano is applied to the wiring VL and a potential V1 is applied to the wiring RL; therefore, the drain current flows between the wiring VL and the wiring RL through the transistor 16*t* and the transistor 20.

The potential Vano is preferably higher than the sum of the potential Vcat and the threshold voltage Vthe of the light-emitting element 14. The potential Vano of the wiring VL is applied to the other of the source and the drain of the transistor 15 (the node B) through the transistor 16*t*. The potential V1 applied to the wiring RL is applied to the one of the source and the drain of the transistor 15 (the node C) through the transistor 20. The potential Vcat is applied to the wiring CL.

Note that it is preferable that the potential V1 be sufficiently lower than a potential obtained by subtracting the threshold voltage Vth of the transistor 15 from the potential V0. The light-emitting element 14 does not emit light in the period t1 because the potential V1 can be set sufficiently lower than the sum of the potential Vcat and the threshold voltage Vthe of the light-emitting element 14.

Next, in a period t2, a low-level potential is applied to the wiring GLa, the high-level potential is applied to the wiring GLb, the low-level potential is applied to the wiring GLc, and a low-level potential is applied to the wiring GLd. Accordingly, the transistor 16*t* is turned on, and the transistor 19, the transistor 17*t*, and the transistor 20 are turned off. Since the transistor 19 is off, the potential Vdata is held at the gate of the transistor 15.

The potential Vano is applied to the wiring VL, and the potential Vcat is applied to the wiring CL. Accordingly, the drain current of the transistor 15, the value of which is determined in the period t1, is supplied to the light-emitting element 14 because the transistor 20 is turned off. By supply of the drain current to the light-emitting element 14, the luminance of the light-emitting element 14 is determined, and the luminance is held in the period t2.

Next, in a period t3, the low-level potential is applied to the wiring GLa, a low-level potential is applied to the wiring GLb, a high-level potential is applied to the wiring GLc, and the low-level potential is applied to the wiring GLd. Accordingly, as illustrated in FIG. 13B, the transistor 17*t* is turned on, and the transistor 19, the transistor 16*t*, and the transistor 20 are turned off. The potential Vcat is applied to the wiring CL. The potential Vano is applied to the wiring ML, which is connected to the monitor circuit.

By the above operation, the drain current of the transistor 15 is supplied to the light-emitting element 14 through the transistor 17*t*. In addition, the drain current is also supplied to the monitor circuit through the wiring ML. The monitor circuit generates a signal including information about the value of the drain current by using the drain current flowing through the wiring ML. Thus, using the above signal, the light-emitting device according to one embodiment of the present invention can correct the value of the potential Vdata of the image signal Sig supplied to the pixel 11.

Note that in the light-emitting device including the pixel 11 illustrated in FIG. 11, the operation in the period t3 is not necessarily performed after the operation in the period t2. For example, in the light-emitting device, the operation in the period t3 may be performed after the operations in the periods t1 and t2 are repeated a plurality of times. Alternatively, after the operation in the period t3 is performed on pixels 11 in one row, the light-emitting elements 14 may be brought into a non-light-emitting state by writing an image signal corresponding to the lowest grayscale level 0 to the pixels 11 in the row which have been subjected to the above operation. Then, the operation in the period t3 may be performed on pixels 11 in the next row.

In the pixel 11 illustrated in FIG. 11, even when variation in resistance of a portion between the anode and the cathode of the light-emitting element 14 among pixels is caused by deterioration of the light-emitting element 14 or the like, the potential of the source of the transistor 15 can be set to a predetermined potential V1 at the time of applying the potential Vdata to the gate of the transistor 15 (the node A). Thus, variation in luminance of the light-emitting element 14 among pixels can be prevented.

Example 2 of Operation for External and Internal Corrections

Next, an example of operation of the pixel 11 illustrated in FIG. 11 for internal and external corrections is described.

Figure 14:
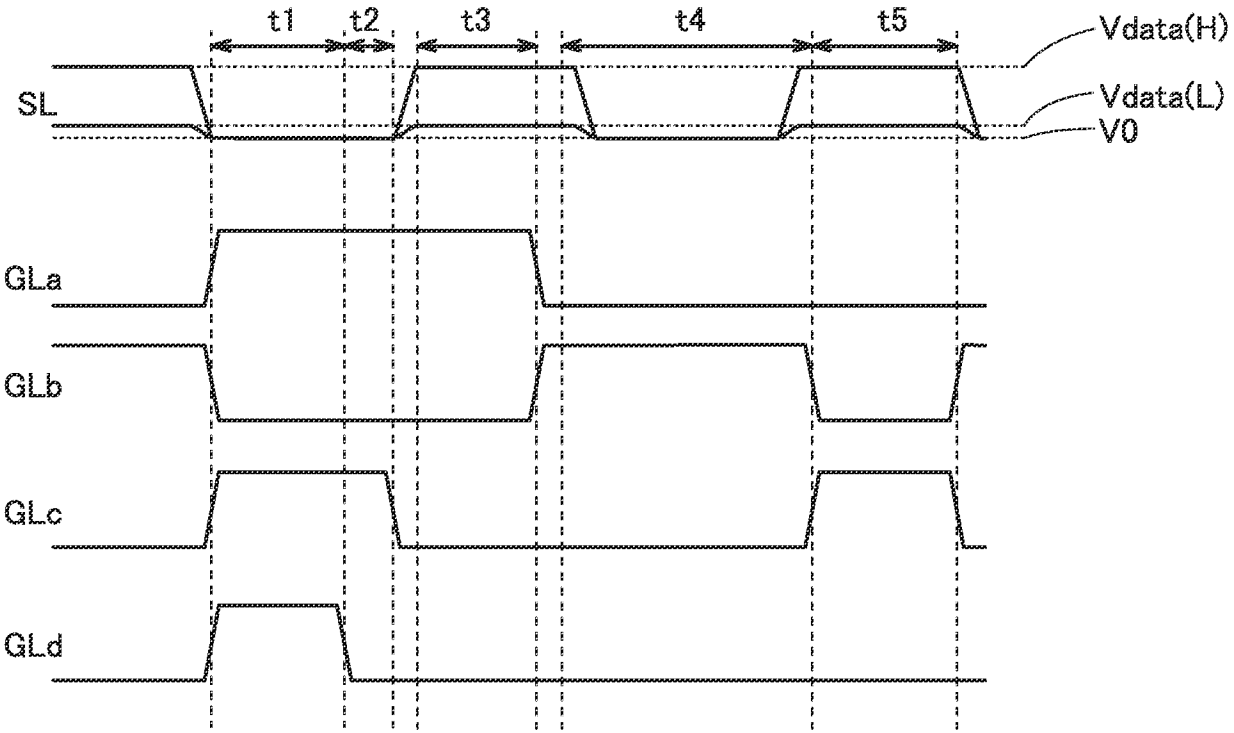
FIG. 14 is a timing chart for a pixel.

FIG. 14 is a timing chart of potentials of the wiring GLa, the wiring GLb, the wiring GLc, and the wiring GLd, which are connected to the pixel 11 illustrated in FIG. 11, and a potential applied to the wiring SL. Note that the timing chart shown in FIG. 14 is an example in which all the transistors included in the pixel 11 illustrated in FIG. 11 are n-channel transistors. FIGS. 15A and 15B, FIGS. 16A and 16B, and FIG. 17 schematically illustrate the operation of the pixel 11 in respective periods. Note that in FIGS. 15A and 15B, the transistors other than the transistor 15 are illustrated as switches for easy understanding of the operation of the pixel 11.

Figure 15A:
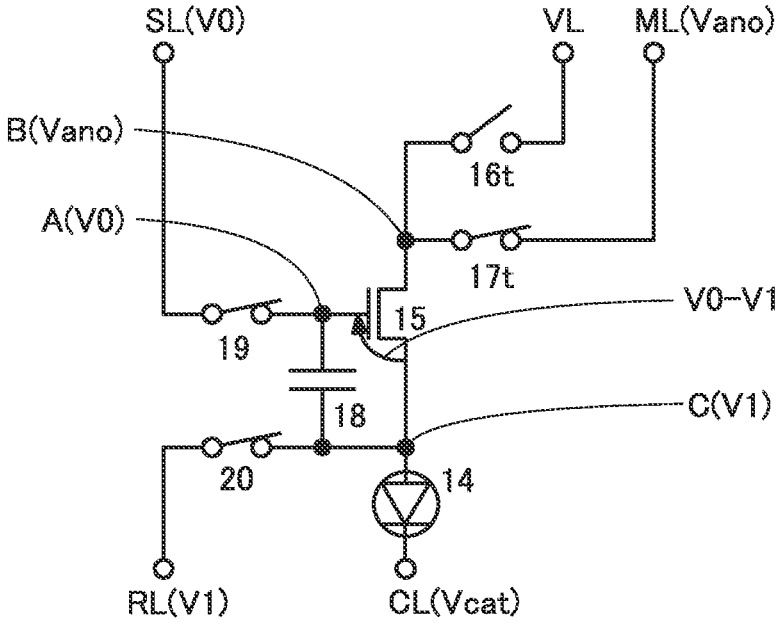
FIGS. 15A and 15B schematically illustrate the operation of a pixel.

First, in a period t1, a high-level potential is applied to the wiring GLa, a low-level potential is applied to the wiring GLb, a high-level potential is applied to the wiring GLc, and a high-level potential is applied to the wiring GLd. Accordingly, as illustrated in FIG. 15A, the transistor 19, the transistor 20, and the transistor 17*t* are turned on, and the transistor 16*t* is turned off. A potential Vano is applied to the wiring ML, a potential Vcat is applied to the wiring CL, a potential V0 is applied to the wiring SL, and a potential V1 is applied to the wiring RL. The potential V0 of the wiring SL is applied to the gate of the transistor 15 (the node A) through the transistor 19, and the potential Vano of the wiring ML is applied to the other of the source and the drain of the transistor 15 (the node B). The potential V1 applied to the wiring RL is applied to the one of the source and the drain of the transistor 15 (the node C) through the transistor 20.

It is preferable that the potential V0 be lower than a potential obtained by adding the threshold voltage Vthe of the light-emitting element 14 and the threshold voltage Vth of the transistor 15 to the potential Vcat. It is preferable that the potential V1 be sufficiently lower than a potential obtained by subtracting the threshold voltage Vth of the transistor 15 from the potential V0.

In the period t1, the gate voltage Vgs of the transistor 15 corresponds to the difference between the potential V0 and the potential V1 and is therefore higher than the threshold voltage, so that the transistor 15 is turned on. The potential Vano is applied to the wiring ML and the potential V1 is applied to the wiring RL; therefore, the drain current of the transistor 15 flows between the wiring VL and the wiring RL through the transistor 17*t* and the transistor 20.

Figure 15B:
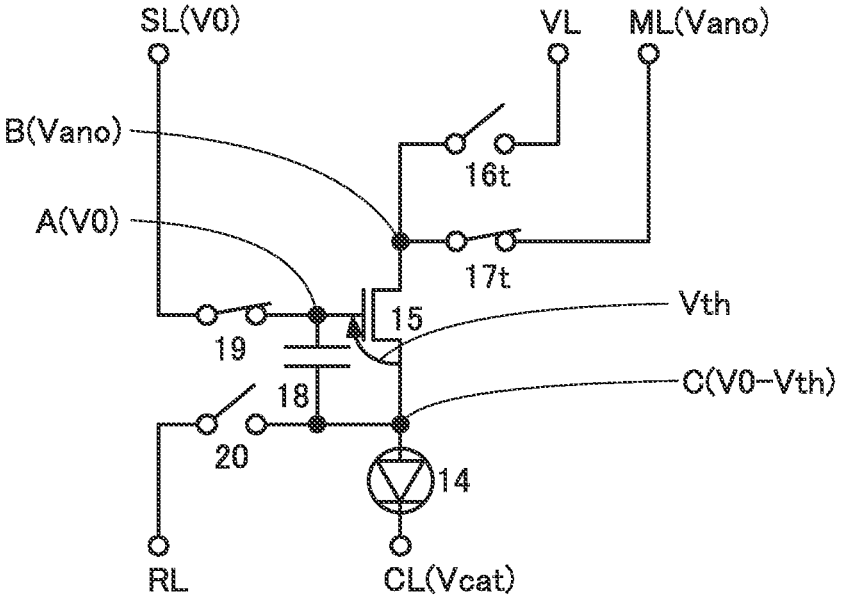

Next, in a period t2, the high-level potential is applied to the wiring GLa, the low-level potential is applied to the wiring GLb, the high-level potential is applied to the wiring GLc, and a low-level potential is applied to the wiring GLd. Accordingly, as illustrated in FIG. 15B, the transistor 19 and the transistor 17*t* are turned on, and the transistor 16*t* and the transistor 20 are turned off. The potential Vano is applied to the wiring ML, the potential Vcat is applied to the wiring CL, and the potential V0 is applied to the wiring SL. The potential V0 of the wiring SL is applied to the gate of the transistor 15 through the transistor 19, and the potential Vano of the wiring ML is applied to the other of the source and the drain of the transistor 15 (the node B).

At the start of the period t2, since the transistor 15 is in an on state and the potential Vano of the wiring ML is applied to the other of the source and the drain of the transistor 15, charge in the capacitor 18 is released through the transistor 15. The potential of the one of the source and the drain of the transistor 15 (the node C) starts to increase from the potential V1 and eventually converges to a potential V0−Vth. Accordingly, the transistor 15 is turned off, so that the capacitor 18 acquires the threshold voltage Vth.

Note that the light-emitting element 14 does not emit light in the period t2 because the potential of the one of the source and the drain of the transistor 15 (the node C) is the potential V0−Vth and is lower than the sum of the potential Vcat and the threshold voltage Vthe of the light-emitting element 14.

Figure 16A:
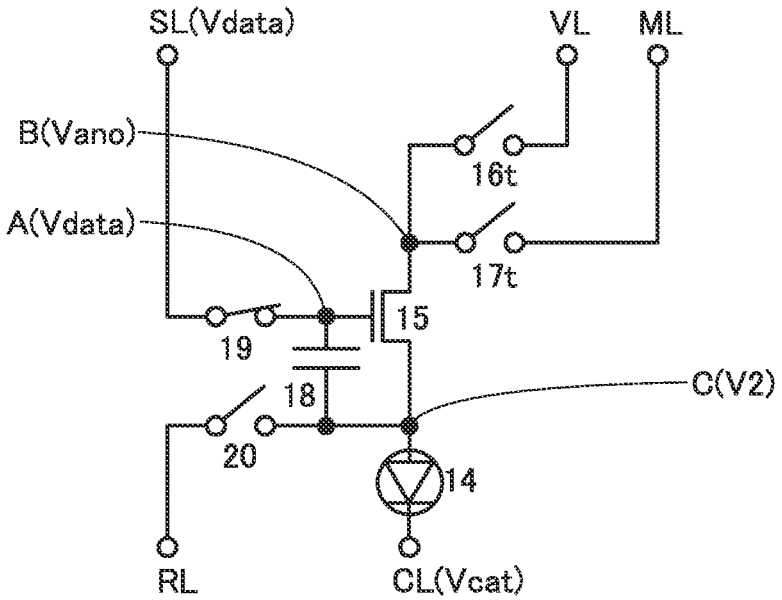
FIGS. 16A and 16B schematically illustrate the operation of a pixel.

Next, in a period t3, the high-level potential is applied to the wiring GLa, the low-level potential is applied to the wiring GLb, a low-level potential is applied to the wiring GLc, and the low-level potential is applied to the wiring GLd. Accordingly, as illustrated in FIG. 16A, the transistor 19 is turned on, and the transistor 16*t*, the transistor 17*t*, and the transistor 20 are turned off. The potential Vcat is applied to the wiring CL, and a potential Vdata of an image signal Sig is applied to the wiring SL.

The potential Vdata applied to the wiring SL is applied to the gate of the transistor 15 (the node A) through the transistor 19. Note that the level of the potential Vdata is varied depending on image information included in the image signal Sig. FIG. 14 illustrates both the case where a high-level potential Vdata(H) is applied to the wiring SL in the period t4 and the case where a low-level potential Vdata(L) is applied thereto.

Note that in the case where the transistor 15 is turned off, the potential V2 of the node C at the end of the period t3 in the pixel 11 illustrated in FIG. 11, like the potential V2 of the node C at the end of the period t4 in the pixel 11 illustrated in FIG. 3, is determined by the ratio of a capacitance C1 of the capacitor 18 to a capacitance C2 of the light-emitting element 14. In the case where the transistor 15 is turned on in the period t3, charge flows into the node C; therefore, the potential V2 of the node C at the end of the period t3 is not determined by the ratio of the capacitance C1 of the capacitor 18 to the capacitance C2 of the light-emitting element 14 alone, and the value thereof changes depending on the amount of charge flowing into the node C. Specifically, the gate voltage Vgs of the transistor 15 at the end of the period t3 is represented by Formula 1 given above.

Note that an ideal gate voltage Vgs at the end of the period t3 is Vdata−V0+Vth. When the gate voltage Vgs has this value, even when the threshold voltages Vth of the transistors 15 vary, the variation does not influence the drain current of the transistors 15. In order to make the gate voltage Vgs close to the ideal voltage, it is found preferable from Formula 1 that C2/(C1+C2) be close to 1. In other words, it is preferable that the capacitance C2 of the light-emitting element 14 be sufficiently larger than the capacitance C1 of the capacitor 18 because the gate voltage Vgs can be made close to the ideal value.

Furthermore, in order to make the gate voltage Vgs close to the ideal value, it is found preferable from Formula 1 that Q1/(C1+C2) be small. In other words, it is preferable that the amount Q1 of charge flowing into the node C be made small in order to make the gate voltage Vgs close to the ideal value. Accordingly, the period t3 is preferably as short as possible in order to make the amount Q1 of charge small.

Note that, in the light-emitting device including the pixel 11 illustrated in FIG. 11, the other of the source and the drain of the transistor 15 is electrically isolated from the gate of the transistor 15, so that their potentials can be individually controlled. Accordingly, in the period t2, the potential of the other of the source and the drain of the transistor 15 can be set higher than a potential obtained by adding the threshold voltage Vth to the potential of the gate of the transistor 15. Therefore, in the case where the transistor 15 is a normally-on transistor, in other words, in the case where the threshold voltage Vth is negative, charge can be accumulated in the capacitor 18 until the potential of the source of the transistor 15 becomes higher than the potential V0 of the gate. Accordingly, in the light-emitting device according to one embodiment of the present invention, even when the transistor 15 is a normally-on transistor, the capacitor 18 acquires the threshold voltage in the period t2, and in the period t3, the gate voltage Vgs of the transistor 15 can be set to a value obtained by taking the threshold voltage Vth into account.

Thus, in the light-emitting device according to one embodiment of the present invention, for example, in the case where an oxide semiconductor is used for the semiconductor film of the transistor 15, even when the transistor 15 is a normally-on transistor, display unevenness can be reduced and a high-quality image can be displayed.

The gate voltage Vgs set in the period t3 is held by the capacitor 18.

Figure 16B:
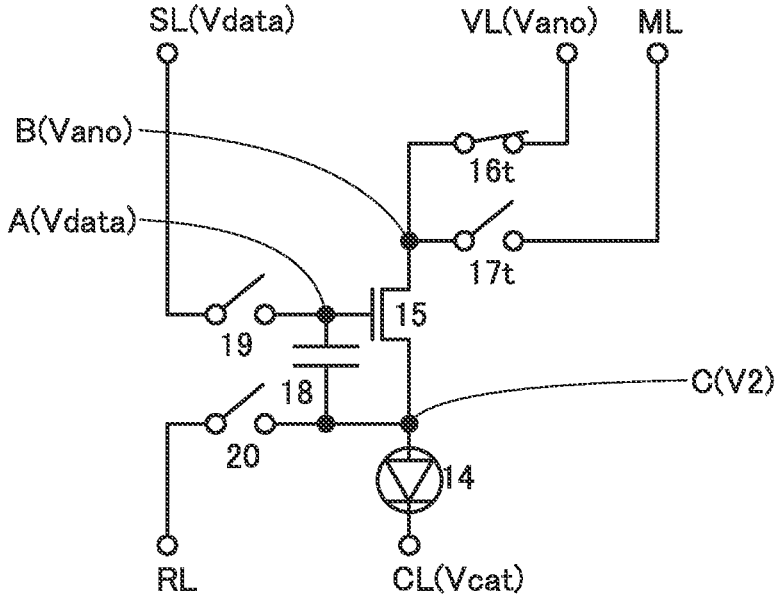

Next, in a period t4, a low-level potential is applied to the wiring GLa, a high-level potential is applied to the wiring GLb, the low-level potential is applied to the wiring GLc, and the low-level potential is applied to the wiring GLd. Accordingly, as illustrated in FIG. 16B, the transistor 16*t* is turned on, and the transistor 19, the transistor 17*t*, and the transistor 20 are turned off. Since the transistor 19 is turned off, the potential Vdata is held at the gate of the transistor 15. The potential Vano is applied to the wiring VL, and the potential Vcat is applied to the wiring CL. Thus, the light-emitting element 14 maintains the luminance determined in the period t3.

Figure 17:
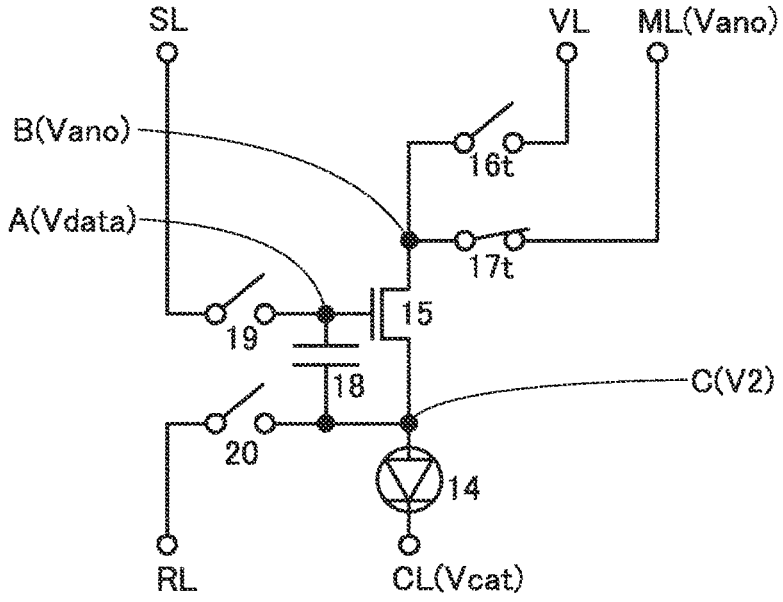
FIG. 17 schematically illustrates the operation of a pixel.

Next, in a period t5, the low-level potential is applied to the wiring GLa, the low-level potential is applied to the wiring GLb, the high-level potential is applied to the wiring GLc, and the low-level potential is applied to the wiring GLd. Accordingly, as illustrated in FIG. 17, the transistor 17*t* is turned on, and the transistor 19, the transistor 16*t*, and the transistor 20 are turned off. The potential Vcat is applied to the wiring CL. The potential Vano is applied to the wiring ML, which is connected to the monitor circuit.

By the above operation, the drain current of the transistor 15 is supplied to the light-emitting element 14 through the transistor 17*t*. In addition, the drain current is also supplied to the monitor circuit through the wiring ML. The monitor circuit generates a signal including information about the value of the drain current by using the drain current flowing through the wiring ML. Thus, using the above signal, the light-emitting device according to one embodiment of the present invention can correct the value of the potential Vdata of the image signal Sig supplied to the pixel 11.

Note that in the light-emitting device including the pixel 11 illustrated in FIG. 11, the operation in the period t5 is not necessarily performed after the operation in the period t4. For example, in the light-emitting device, the operation in the period t5 may be performed after the operations in the periods t1 to t4 are repeated a plurality of times. Alternatively, after the operation in the period t5 is performed on pixels 11 in one row, the light-emitting elements 14 may be brought into a non-light-emitting state by writing an image signal corresponding to the lowest grayscale level 0 to the pixels 11 in the row which have been subjected to the above operation. Then, the operation in the period t5 may be performed on pixels 11 in the next row.

Configuration Example of Monitor Circuit

Figure 18:
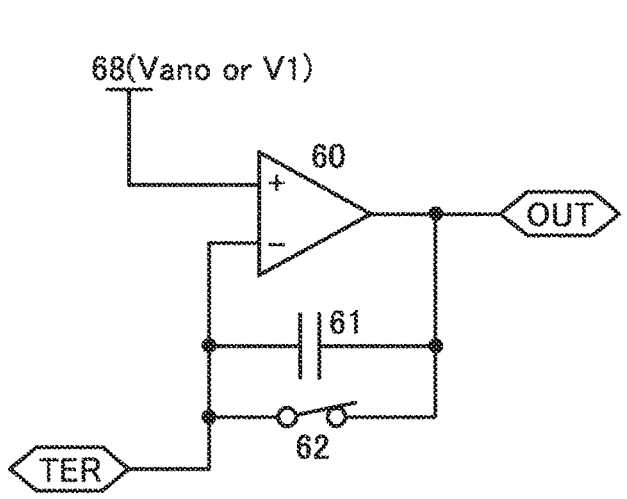
FIG. 18 is a circuit diagram of a monitor circuit.

Next, a configuration example of the monitor circuit 12 is illustrated in FIG. 18. The monitor circuit 12 illustrated in FIG. 18 includes an operational amplifier 60, a capacitor 61, and a switch 62.

One of a pair of electrodes of the capacitor 61 is connected to an inverting input terminal (−) of the operational amplifier 60, and the other of the pair of electrodes of the capacitor 61 is connected to an output terminal of the operation amplifier 60. The switch 62 has a function of releasing charge accumulated in the capacitor 61, and specifically has a function of controlling electrical connection between the pair of electrodes of the capacitor 61. A non-inverting input terminal (+) of the operational amplifier 60 is connected to a wiring 68, and the potential Vano or the potential V1 is applied to the wiring 68.

In one embodiment of the present invention, the monitor circuit 12 functions as a voltage follower when the potential Vano or the potential V1 is applied to the wiring ML of the pixel 11 in order to perform internal correction. Specifically, by turning on the switch 62, the potential Vano or the potential V1 applied to the wiring 68 can be applied to the wiring ML from a wiring TER through the monitor circuit 12.

When current is extracted from the pixel 11 through the wiring ML in order to perform external correction, the monitor circuit 12 functions as a voltage follower, thereby applying the potential Vano to the wiring ML, and then functions as an integrator circuit, thereby converting the current extracted from the pixel 11 into voltage. Specifically, by turning on the switch 62, the potential Vano applied to the wiring 68 is applied to the wiring ML through the monitor circuit 12, and then, the switch 62 is turned off. When the switch 62 is in an off state and the drain current is extracted to the wiring TER from the pixel 11, charge is accumulated in the capacitor 61, so that a voltage is generated between the pair of electrodes of the capacitor 61. The voltage is proportional to the total amount of charge extracted to the wiring TER in accordance with the drain current; therefore, a potential corresponding to the total amount of charge in accordance with the drain current in a predetermined period is applied to a wiring OUT connected to the output terminal of the operational amplifier 60 and the potential is supplied to the image processing circuit as a signal including information about a value of current.

Note that in the case of internal correction of the pixel 11 illustrated in FIG. 3, the potential applied to the wiring ML of the pixel 11 switches between the potential Vano and the potential V1 as illustrated in FIGS. 7A and 7B and FIGS. 8A and 8B. This potential switching can be performed by switching the potential applied to the wiring 68 of the monitor circuit 12 between the potential Vano and the potential V1.

In addition, a selection circuit which has a function of selecting a wiring to which the potential V1 is applied or the wiring TER of the monitor circuit 12 and electrically connecting the selected wiring and the wiring ML of the pixel 11 may be provided in the light-emitting device. In the case where the selection circuit is provided in the light-emitting device, the potential Vano may be applied to the wiring 68 of the monitor circuit 12 without being switched to another potential.

<Connection Between Pixel Portion and Selection Circuit>

Figure 19:
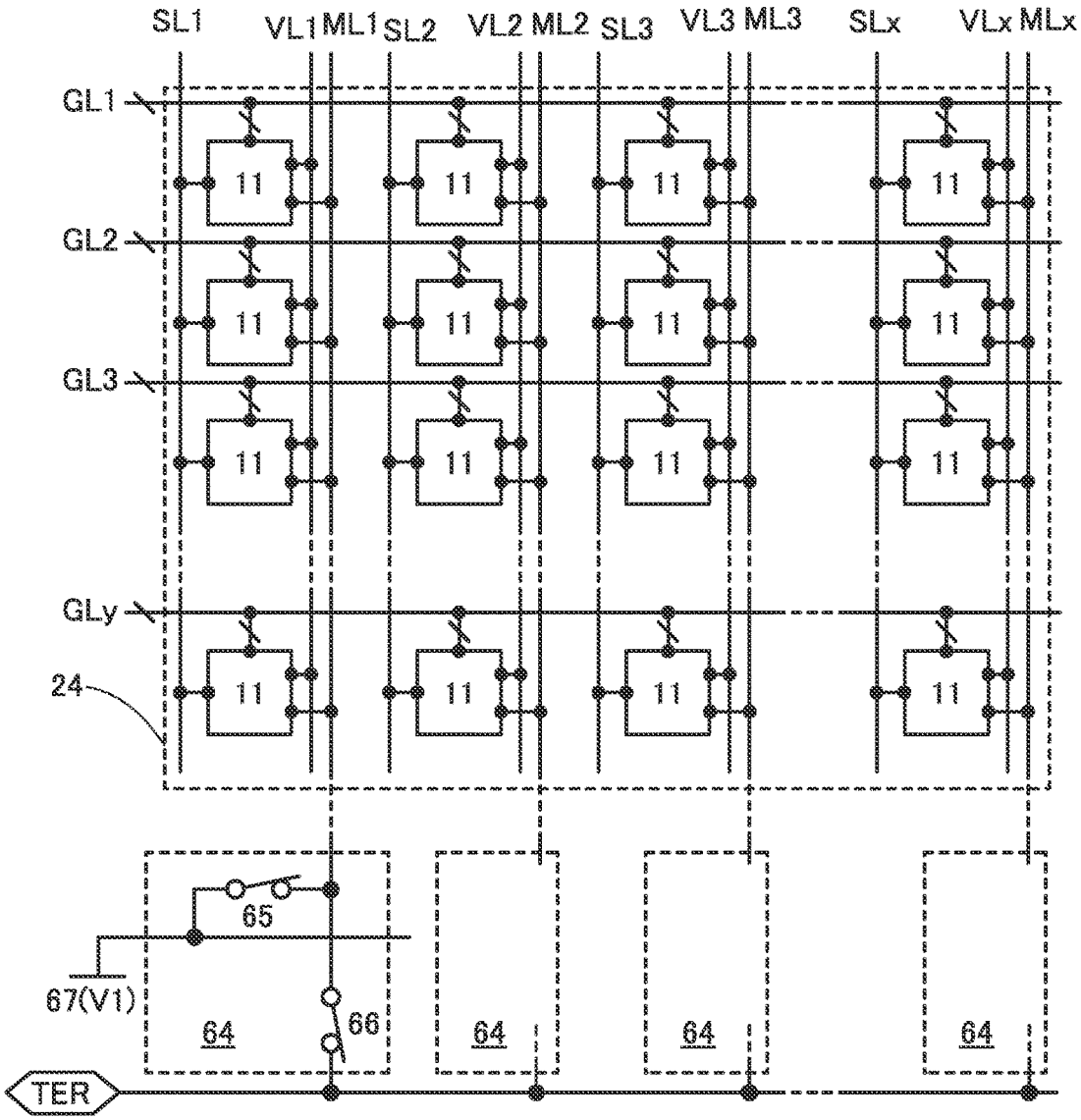
FIG. 19 illustrates configurations of a pixel portion and a selection circuit.

Next, an example of a connection between the pixel portion 24 illustrated in FIG. 2 and a selection circuit 64 is described. FIG. 19 illustrates an example of configurations of the pixel portion 24 and the selection circuit 64.

The pixel portion 24 illustrated in FIG. 19 is provided with a plurality of pixels 11, a plurality of wirings GL (wirings GL1 to GLy), a plurality of wirings SL (wirings SL1 to SLx), a plurality of wirings ML (wirings ML1 to MLx), and a plurality of wirings VL (wirings VL1 to VLx). Each of the wirings GL1 to GLy corresponds to a plurality of wirings connected to gates of a plurality of transistors included in each of the pixels 11. For example, in the case of the pixel 11 illustrated in FIG. 3, the wirings GLa to GLc correspond to one of the wirings GL1 to GLy. For example, in the case of the pixel 11 illustrated in FIG. 11, the wirings GLa to GLd correspond to one of the wirings GL1 to GLy. Each of the plurality of pixels 11 is connected to at least one of the wirings GL, at least one of the wirings SL, at least one of the wirings ML, and at least one of the wirings VL.

Note that the kind and number of the wirings in the pixel portion 24 can be determined by the configuration, number, and arrangement of the pixels 11. Specifically, in the pixel portion 24 illustrated in FIG. 19, the pixels 11 are arranged in a matrix of x columns and y rows, and the wirings GL1 to GLy, the wirings SL1 to SLx, the wirings ML1 to MLx, and the wirings VL1 to VLx are provided in the pixel portion 24 as an example.

The selection circuit 64 has a function of controlling electrical connection between one of the wirings ML1 to MLx and the wiring TER of the monitor circuit (not illustrated). Specifically, the selection circuit 64 includes a switch 65 for controlling electrical connection between a wiring 67 to which the potential V1 is applied and one of the wirings ML, and a switch 66 for controlling electrical connection between the one of the wirings ML and the wiring TER.

<Cross-Sectional Structure of Light-Emitting Device>

Figure 20:
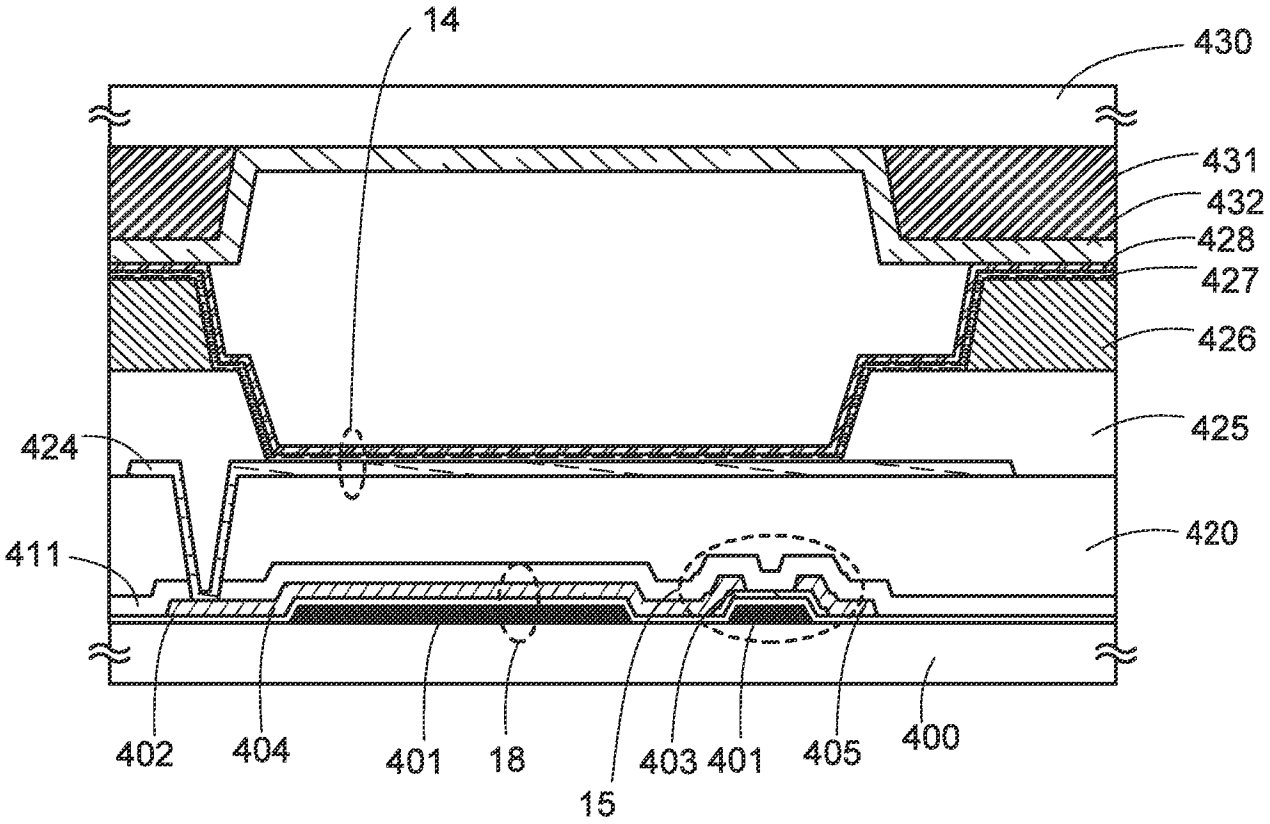
FIG. 20 is a cross-sectional view of a light-emitting device.

FIG. 20 illustrates, as an example, a cross-sectional structure of a pixel portion in a light-emitting device according to one embodiment of the present invention. Note that FIG. 20 illustrates the cross-sectional structures of the transistor 15, the capacitor 18, and the light-emitting element 14 of the pixel 11 illustrated in FIG. 3.

Specifically, the light-emitting device in FIG. 20 includes the transistor 15 and the capacitor 18 over a substrate 400. The transistor 15 includes a conductive film 401 that functions as a gate; an insulating film 402 over the conductive film 401; a semiconductor film 403 that overlaps with the conductive film 401 with the insulating film 402 positioned therebetween; and conductive films 404 and 405 that function as a source and a drain electrically connected to the semiconductor film 403.

The capacitor 18 includes the conductive film 401 that functions as an electrode; the insulating film 402 over the conductive film 401; and the conductive film 404 that overlaps with the conductive film 401 with the insulating film 402 positioned therebetween and functions as an electrode.

The insulating film 402 may be formed as a single layer or a stacked layer using one or more insulating films containing any of aluminum oxide, magnesium oxide, silicon oxide, silicon oxynitride, silicon nitride oxide, silicon nitride, gallium oxide, germanium oxide, yttrium oxide, zirconium oxide, lanthanum oxide, neodymium oxide, hafnium oxide, and tantalum oxide. Note that in this specification, "oxynitride" refers to a material that contains oxygen at a higher proportion than nitrogen, and "nitride oxide" refers to a material that contains nitrogen at a higher proportion than oxygen.

An insulating film 411 is provided over the semiconductor film 403 and the conductive films 404 and 405. In the case where an oxide semiconductor is used for the semiconductor film 403, it is preferable that a material that can supply oxygen to the semiconductor film 403 be used for the insulating film 411. By using the material for the insulating film 411, oxygen contained in the insulating film 411 can be moved to the semiconductor film 403, and the amount of oxygen vacancy in the semiconductor film 403 can be reduced. Oxygen contained in the insulating film 411 can be moved to the semiconductor film 403 efficiently by heat treatment performed after the insulating film 411 is formed.

An insulating film 420 is provided over the insulating film 411, and a conductive film 424 is provided over the insulating film 420. The conductive film 424 is connected to the conductive film 404 through an opening formed in the insulating films 411 and 420.

An insulating film 425 is provided over the insulating film 420 and the conductive film 424. The insulating film 425 has an opening that overlaps with the conductive film 424. Over the insulating film 425, an insulating film 426 is provided in a position that is different from the position of the opening of the insulating film 425. An EL layer 427 and a conductive film 428 are sequentially stacked over the insulating films 425 and 426. A portion in which the conductive films 424 and 428 overlap with each other with the EL layer 427 positioned therebetween functions as the light-emitting element 14. One of the conductive films 424 and 428 functions as an anode, and the other functions as a cathode.

The light-emitting device includes a substrate 430 that faces the substrate 400 with the light-emitting element 14 positioned therebetween. A blocking film 431 that has a function of blocking light is provided over the substrate 430, i.e., over a surface of the substrate 430 that is closer to the light-emitting element 14. The blocking film 431 has an opening that overlaps with the light-emitting element 14. In the opening that overlaps with the light-emitting element 14, a coloring layer 432 that transmits visible light in a specific wavelength range is provided over the substrate 430.

<Structure of Transistor>

Next, a structure of a transistor 70 that includes a channel formation region in an oxide semiconductor film is described as an example.

Figure 21A:
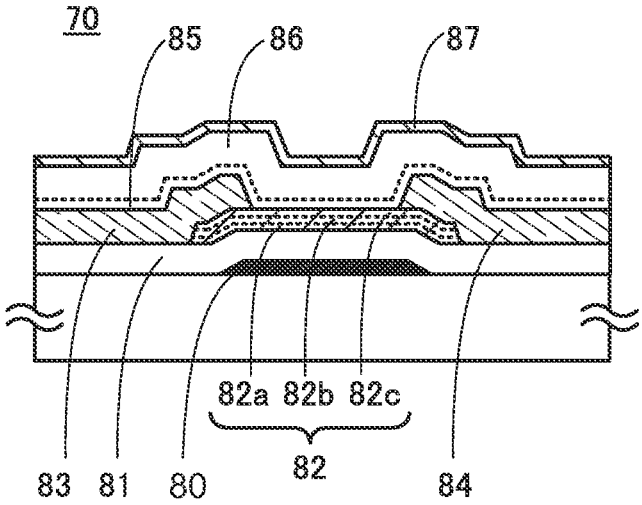
FIGS. 21A and 21B are each a cross-sectional view of a transistor.

The transistor 70 in FIG. 21A includes a conductive film 80 that functions as a gate; an insulating film 81 over the conductive film 80; an oxide semiconductor film 82 that overlaps with the conductive film 80 with the insulating film 81 positioned therebetween; and conductive films 83 and 84 that function as a source and a drain connected to the oxide semiconductor film 82. The transistor 70 in FIG. 21A further includes insulating films 85 to 87 sequentially stacked over the oxide semiconductor film 82 and the conductive films 83 and 84.

Note that in FIG. 21A, the insulating films 85 to 87 are sequentially stacked over the oxide semiconductor film 82 and the conductive films 83 and 84; however, the number of insulating films provided over the oxide semiconductor film 82 and the conductive films 83 and 84 may be one or three or more.

The insulating film 86 preferably contains oxygen at a proportion higher than or equal to the stoichiometric composition and has a function of supplying part of oxygen to the oxide semiconductor film 82 by heating. Further, the insulating film 86 preferably has a few defects, and typically the spin density at g=2.001 due to a dangling bond of silicon is preferably lower than or equal to $1\times10^{18}$ spins/cm$^3$ when measured by ESR. Note that in the case where the insulating film 86 is directly provided on the oxide semiconductor film 82 and the oxide semiconductor film 82 is damaged at the time of formation of the insulating film 86, the insulating film 85 is preferably provided between the oxide semiconductor film 82 and the insulating film 86, as illustrated in FIG. 21A. The insulating film 85 preferably causes little damage to the oxide semiconductor film 82 when the insulating film 85 is formed compared with the case of the insulating film 86 and has a function of allowing oxygen to pass therethrough. If damage to the oxide semiconductor film 82 can be reduced and the insulating film 86 can be formed directly on the oxide semiconductor film 82, the insulating film 85 is not necessarily provided.

The insulating film 85 preferably has a few defects, and typically the spin density at g=2.001 due to a dangling bond of silicon is preferably lower than or equal to $3\times10^{17}$ spins/cm$^3$ when measured by ESR. This is because if the density of defects in the insulating film 85 is high, oxygen is bonded to the defects and the amount of oxygen that permeates the insulating film 85 is decreased.

Furthermore, the interface between the insulating film 85 and the oxide semiconductor film 82 preferably has a few defects, and typically the spin density at g=1.89 to 1.96 due to oxygen vacancies in an oxide semiconductor used for the oxide semiconductor film 82 is preferably lower than or equal to $1\times10^{17}$ spins/cm$^3$, more preferably lower than or equal to the lower detection limit when measured by ESR where a magnetic field is applied parallel to a film surface.

The insulating film 87 preferably has an effect of blocking diffusion of oxygen, hydrogen, and water. Alternatively, the insulating film 87 preferably has an effect of blocking diffusion of hydrogen and water.

As an insulating film has higher density and becomes denser or has a fewer dangling bonds and becomes more chemically stable, the insulating film has a higher blocking effect. An insulating film that has an effect of blocking diffusion of oxygen, hydrogen, and water can be formed using, for example, aluminum oxide, aluminum oxynitride, gallium oxide, gallium oxynitride, yttrium oxide, yttrium oxynitride, hafnium oxide, or hafnium oxynitride. An insulating film that has an effect of blocking diffusion of hydrogen and water can be formed using, for example, silicon nitride or silicon nitride oxide.

In the case where the insulating film 87 has an effect of blocking diffusion of water, hydrogen, and the like, impurities such as water and hydrogen that exist in a resin in a panel or exist outside the panel can be prevented from entering the oxide semiconductor film 82. Since an oxide semiconductor is used for the oxide semiconductor film 82, part of water or hydrogen entering the oxide semiconductor serves as an electron donor (donor). Thus, the use of the insulating film 87 having the blocking effect can prevent a shift in threshold voltage of the transistor 70 due to generation of donors.

In addition, since an oxide semiconductor is used for the oxide semiconductor film 82, when the insulating film 87 has an effect of blocking diffusion of oxygen, diffusion of oxygen from the oxide semiconductor to the outside can be prevented. Accordingly, oxygen vacancies in the oxide semiconductor that serve as donors are reduced, so that a shift in threshold voltage of the transistor 70 due to generation of donors can be prevented.

Note that FIG. 21A illustrates an example in which the oxide semiconductor film 82 is formed using a stack of three oxide semiconductor films. Specifically, in the transistor 70 in FIG. 21A, the oxide semiconductor film 82 is formed by stacking oxide semiconductor films 82*a* to 82*c* sequentially from the insulating film 81 side. The oxide semiconductor film 82 of the transistor 70 is not limited to a stack of a plurality of oxide semiconductor films, and may be a single oxide semiconductor film.

The oxide semiconductor films 82*a* and 82*c* are each an oxide film that contains at least one of metal elements contained in the oxide semiconductor film 82*b*. The energy at the bottom of the conduction band of the oxide semiconductor films 82*a* and 82*c* is closer to a vacuum level than that of the oxide semiconductor film 82*b* by 0.05 eV or more, 0.07 eV or more, 0.1 eV or more, or 0.15 eV or more and 2 eV or less, 1 eV or less, 0.5 eV or less, or 0.4 eV or less. The oxide semiconductor film 82*b* preferably contains at least indium in order to increase carrier mobility.

Figure 21B:
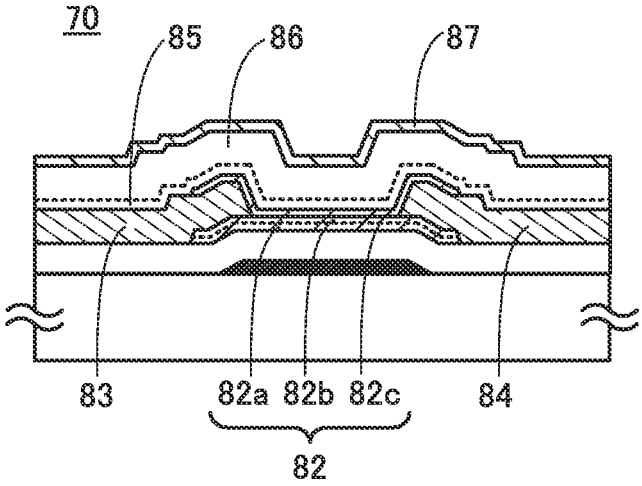

As illustrated in FIG. 21B, over the conductive films 83 and 84, the oxide semiconductor film 82*c* of the transistor 70 may overlap with the insulating film 85.

There are a few carrier generation sources in a highly purified oxide semiconductor (purified oxide semiconductor) obtained by reduction of impurities such as moisture and hydrogen serving as electron donors (donors) and reduction of oxygen vacancies; therefore, the highly purified oxide semiconductor can be an intrinsic (i-type) semiconductor or a substantially i-type semiconductor. Thus, a transistor including a channel formation region in a highly purified oxide semiconductor film has extremely low off-state current and high reliability. Thus, a transistor in which a channel formation region is formed in the oxide semiconductor film is likely to have positive threshold voltage (normally-off characteristics).

Specifically, various experiments can prove low off-state current of a transistor including a channel formation region in a highly purified oxide semiconductor film. For example, the off-state current of even an element having a channel width of $1\times10^6$ μm and a channel length of 10 μm can be less than or equal to the measurement limit of a semiconductor parameter analyzer, that is, less than or equal to $1\times10^{-13}$ A at a voltage between the source electrode and the drain electrode (a drain voltage) of 1 V to 10 V. In this case, it can be seen that off-state current normalized by the channel width of the transistor is less than or equal to 100 zA/μm. In addition, the off-state current is measured using a circuit in which a capacitor and a transistor are connected to each other and charge flowing into or from the capacitor is controlled by the transistor. In the measurement, a highly purified oxide semiconductor film is used for a channel formation region of the transistor, and the off-state current of the transistor is measured from a change in the amount of charge of the capacitor per unit time. As a result, it is found that, in the case where the voltage between the source electrode and the drain electrode of the transistor is 3 V, a lower off-state current of several tens of yA/μm is obtained. Consequently, the off-state current of the transistor in which a highly purified oxide semiconductor is used for a channel formation region is much lower than that of a transistor including crystalline silicon.

In the case where an oxide semiconductor film is used as a semiconductor film, at least indium (In) or zinc (Zn) is preferably included as an oxide semiconductor. In addition, as a stabilizer for reducing the variation in electrical characteristics of a transistor using the oxide semiconductor, it is preferable that gallium (Ga) be additionally contained. Tin (Sn) is preferably contained as a stabilizer. Hafnium (Hf) is preferably contained as a stabilizer. Aluminum (Al) is preferably contained as a stabilizer. Zirconium (Zr) is preferably contained as a stabilizer.

Among the oxide semiconductors, unlike silicon carbide, gallium nitride, or gallium oxide, an In—Ga—Zn-based oxide, an In—Sn—Zn-based oxide, or the like has an advantage of high mass productivity because a transistor with favorable electrical characteristics can be formed by a sputtering method or a wet process. Further, unlike silicon carbide, gallium nitride, or gallium oxide, with the use of the In—Ga—Zn-based oxide, a transistor with favorable electrical characteristics can be formed over a glass substrate. Further, a larger substrate can be used.

As another stabilizer, one or more lanthanoids selected from lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), and lutetium (Lu) may be contained.

As the oxide semiconductor, for example, an indium oxide, a gallium oxide, a tin oxide, a zinc oxide, an In—Zn-based oxide, a Sn—Zn-based oxide, an Al—Zn-based oxide, a Zn—Mg-based oxide, a Sn—Mg-based oxide, an In—Mg-based oxide, an In—Ga-based oxide, an In—Ga—Zn-based oxide (also referred to as IGZO), an In—Al—Zn-based oxide, an In—Sn—Zn-based oxide, a Sn—Ga—Zn-based oxide, an Al—Ga—Zn-based oxide, a Sn—Al—Zn-based oxide, an In—Hf—Zn-based oxide, an In—La—Zn-based oxide, an In—Pr—Zn-based oxide, an In—Nd—Zn-based oxide, an In—Ce—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, an In—Lu—Zn-based oxide, an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, or an In—Hf—Al—Zn-based oxide can be used.

Note that, for example, an In—Ga—Zn-based oxide means an oxide containing In, Ga, and Zn, and there is no limitation on the ratio of In:Ga:Zn. In addition, the oxide may contain a metal element other than In, Ga, and Zn. The In—Ga—Zn-based oxide has sufficiently high resistance when no electric field is applied thereto, so that off-state current can be sufficiently reduced. Further, the In—Ga—Zn-based oxide has high mobility.

For example, with the In—Sn—Zn-based oxide, a high mobility can be relatively easily obtained. However, mobility can be increased by reducing the defect density in the bulk also in the case of using the In—Ga—Zn-based oxide.

A structure of an oxide semiconductor film is described below.

An oxide semiconductor film is classified roughly into a single crystal oxide semiconductor film and a non-single-crystal oxide semiconductor film. The non-single-crystal oxide semiconductor film includes any of an amorphous oxide semiconductor film, a microcrystalline oxide semiconductor film, a polycrystalline oxide semiconductor film, a CAAC-OS film, and the like.

The amorphous oxide semiconductor film has disordered atomic arrangement and no crystalline component. A typical example thereof is an oxide semiconductor film in which no crystal part exists even in a microscopic region, and the whole of the film is amorphous.

The microcrystalline oxide semiconductor film includes a microcrystal (also referred to as nanocrystal) with a size greater than or equal to 1 nm and less than 10 nm, for example. Thus, the microcrystalline oxide semiconductor film has a higher degree of atomic order than the amorphous oxide semiconductor film. Hence, the density of defect states of the microcrystalline oxide semiconductor film is lower than that of the amorphous oxide semiconductor film.

The CAAC-OS film is one of oxide semiconductor films including a plurality of crystal parts, and most of the crystal parts each fit inside a cube whose one side is less than 100 nm. Thus, there is a case where a crystal part included in the CAAC-OS film fits inside a cube whose one side is less than 10 nm, less than 5 nm, or less than 3 nm. The density of defect states of the CAAC-OS film is lower than that of the microcrystalline oxide semiconductor film. In a transmission electron microscope (TEM) image of the CAAC-OS film, a boundary between crystal parts, that is, a grain boundary is not clearly observed. Thus, in the CAAC-OS film, a reduction in electron mobility due to the grain boundary is less likely to occur.

According to the TEM image of the CAAC-OS film observed in a direction substantially parallel to a sample surface (cross-sectional TEM image), metal atoms are arranged in a layered manner in the crystal parts. Each metal atom layer has a morphology reflecting a surface where the CAAC-OS film is formed (hereinafter, a surface where the CAAC-OS film is formed is also referred to as a formation surface) or a top surface of the CAAC-OS film, and is arranged in parallel to the formation surface or the top surface of the CAAC-OS film.

In this specification, the term "parallel" indicates that the angle formed between two straight lines is greater than or equal to −10° and less than or equal to 10°, and accordingly also includes the case where the angle is greater than or equal to −5° and less than or equal to 5°. In addition, the term "perpendicular" indicates that the angle formed between two straight lines is greater than or equal to 80° and less than or equal to 100°, and accordingly also includes the case where the angle is greater than or equal to 85° and less than or equal to 95°.

On the other hand, according to a TEM image of the CAAC-OS film observed in a direction substantially perpendicular to the sample surface (plan TEM image), metal atoms are arranged in a triangular or hexagonal configuration in the crystal parts. However, there is no regularity of arrangement of metal atoms between different crystal parts.

From the results of the cross-sectional TEM image and the plan TEM image, alignment is found in the crystal parts in the CAAC-OS film.

A CAAC-OS film is subjected to structural analysis with an X-ray diffraction (XRD) apparatus. For example, when the CAAC-OS film including an $InGaZnO_4$ crystal is analyzed by an out-of-plane method, a peak appears frequently when the diffraction angle (2θ) is around 31°. This peak is derived from the (009) plane of the $InGaZnO_4$ crystal, which indicates that crystals in the CAAC-OS film have c-axis alignment, and that the c-axes are aligned in a direction substantially perpendicular to the formation surface or the top surface of the CAAC-OS film.

On the other hand, when the CAAC-OS film is analyzed by an in-plane method in which an X-ray enters a sample in a direction substantially perpendicular to the c-axis, a peak appears frequently when 2θ is around 56°. This peak is derived from the (110) plane of the $InGaZnO_4$ crystal. Here, analysis (φ scan) is performed under conditions where the sample is rotated around a normal vector of a sample surface as an axis (φ axis) with 2θ fixed at around 56°. In the case where the sample is a single crystal oxide semiconductor film of $InGaZnO_4$, six peaks appear. The six peaks are derived from crystal planes equivalent to the (110) plane. On the other hand, in the case of a CAAC-OS film, a peak is not clearly observed even when φ scan is performed with 2θ fixed at around 56°.

According to the above results, in the CAAC-OS film having c-axis alignment, while the directions of a-axes and b-axes are different between crystal parts, the c-axes are aligned in a direction parallel to a normal vector of a formation surface or a normal vector of a top surface. Thus, each metal atom layer arranged in a layered manner observed in the cross-sectional TEM image corresponds to a plane parallel to the a-b plane of the crystal.

Note that the crystal part is formed concurrently with deposition of the CAAC-OS film or is formed through crystallization treatment such as heat treatment. As described above, the c-axis of the crystal is aligned in a direction parallel to a normal vector of a formation surface or a normal vector of a top surface of the CAAC-OS film. Thus, for example, in the case where a shape of the CAAC-OS film is changed by etching or the like, the c-axis might not be necessarily parallel to a normal vector of a formation surface or a normal vector of a top surface of the CAAC-OS film.

Further, the degree of crystallinity in the CAAC-OS film is not necessarily uniform. For example, in the case where crystal growth leading to the CAAC-OS film occurs from the vicinity of the top surface of the film, the degree of the crystallinity in the vicinity of the top surface is higher than that in the vicinity of the formation surface in some cases. Further, when an impurity is added to the CAAC-OS film, the crystallinity in a region to which the impurity is added is changed, and the degree of crystallinity in the CAAC-OS film varies depending on regions.

Note that when the CAAC-OS film with an $InGaZnO_4$ crystal is analyzed by an out-of-plane method, a peak of 2θ may also be observed at around 36°, in addition to the peak of 2θ at around 31°. The peak of 2θ at around 36° indicates that a crystal having no c-axis alignment is included in part of the CAAC-OS film. It is preferable that in the CAAC-OS film, a peak of 2θ appear at around 31° and a peak of 2θ not appear at around 36°.

With use of the CAAC-OS film in a transistor, a variation in the electrical characteristics of the transistor due to irradiation with visible light or ultraviolet light is small. Thus, the transistor has high reliability.

Note that an oxide semiconductor film may be a stacked film including two or more kinds of an amorphous oxide semiconductor film, a microcrystalline oxide semiconductor film, and a CAAC-OS film, for example.

For the deposition of the CAAC-OS film, the following conditions are preferably used.

By reducing the amount of impurities entering the CAAC-OS film during the deposition, the crystal state can be prevented from being broken by the impurities. For example, the concentration of impurities (e.g., hydrogen, water, carbon dioxide, or nitrogen) which exist in a treatment chamber may be reduced. Furthermore, the concentration of impurities in a deposition gas may be reduced. Specifically, a deposition gas whose dew point is −80° C. or lower, preferably −100° C. or lower is used.

By increasing the substrate heating temperature during the deposition, migration of a sputtered particle is likely to occur after the sputtered particle reaches a substrate surface. Specifically, the substrate heating temperature during the deposition is higher than or equal to 100° C. and lower than or equal to 740° C., preferably higher than or equal to 200° C. and lower than or equal to 500° C. By increasing the substrate heating temperature during the deposition, when the flat-plate-like sputtered particle reaches the substrate, migration occurs on the substrate surface, so that a flat plane of the sputtered particle is attached to the substrate.

Furthermore, preferably, the proportion of oxygen in the deposition gas is increased and the power is optimized in order to reduce plasma damage at the deposition. The proportion of oxygen in the deposition gas is 30 vol % or higher, preferably 100 vol %.

As an example of the target, an In—Ga—Zn-based oxide target is described below.

The In—Ga—Zn-based oxide target, which is polycrystalline, is made by mixing $InO_X$ powder, $GaO_Y$ powder, and $ZnO_Z$ powder in a predetermined molar ratio, applying pressure, and performing heat treatment at a temperature higher than or equal to 1000° C. and lower than or equal to 1500° C. Note that X, Y, and Z are given positive numbers. Here, the predetermined molar ratio of $InO_X$ powder to $GaO_Y$ powder and $ZnO_Z$ powder is, for example, 2:2:1, 8:4:3, 3:1:1, 1:1:1, 4:2:3, 1:4:4, or 3:1:2. The kinds of powders and the molar ratio for mixing powders may be determined as appropriate depending on the desired target.

An alkali metal is not an element included in an oxide semiconductor and thus is an impurity. Likewise, an alkaline earth metal is an impurity when the alkaline earth metal is not a component of the oxide semiconductor. When an insulating film in contact with an oxide semiconductor film is an oxide, Na, among the alkali metals, diffuses into the insulating film and becomes $Na^+$. Further, in the oxide semiconductor film, Na cuts or enters a bond between metal and oxygen which are components of the oxide semiconductor. As a result, the electrical characteristics of the transistor deteriorate; for example, the transistor is placed in a normally-on state due to a negative shift of the threshold voltage or the mobility is decreased. In addition, the characteristics of transistors vary. Specifically, the measurement value of a Na concentration by secondary ion mass spectrometry is preferably $5\times10^{16}/cm^3$ or lower, further preferably $1\times10^{16}/cm^3$ or lower, still further preferably $1\times10^{15}/cm^3$ or lower. Similarly, the measurement value of a Li concentration is preferably $5\times10^{15}/cm^3$ or lower, further preferably $1\times10^{15}/cm^3$ or lower. Similarly, the measurement value of a K concentration is preferably $5\times10^{15}/cm^3$ or lower, further preferably $1\times10^{15}/cm^3$ or lower.

When metal oxide containing indium is used, silicon or carbon having higher bond energy with oxygen than indium might cut the bond between indium and oxygen, so that an oxygen vacancy may be formed. Accordingly, when silicon or carbon is contained in the oxide semiconductor film, the electrical characteristics of the transistor are likely to deteriorate as in the case of using an alkali metal or an alkaline earth metal. Thus, the concentrations of silicon and carbon in the oxide semiconductor film are preferably low. Specifically, the carbon concentration or the silicon concentration measured by secondary ion mass spectrometry is $1\times10^{18}/cm^3$ or lower. In this case, the deterioration of the electrical characteristics of the transistor can be prevented, so that the reliability of a semiconductor device can be improved.

A metal in the source electrode and the drain electrode might extract oxygen from the oxide semiconductor film depending on a conductive material used for the source and drain electrodes. In such a case, a region of the oxide semiconductor film in contact with the source electrode or the drain electrode becomes an n-type region due to the formation of an oxygen vacancy.

The n-type region serves as a source region or a drain region, resulting in a decrease in the contact resistance between the oxide semiconductor film and the source electrode or the drain electrode. Accordingly, the formation of the n-type region increases the mobility and on-state current of the transistor, which achieves high-speed operation of a semiconductor device using the transistor.

Note that the extraction of oxygen by a metal in the source electrode and the drain electrode is probably caused when the source electrode and the drain electrode are formed by a sputtering method or the like or when heat treatment is performed after the formation of the source electrode and the drain electrode.

The n-type region is more likely to be formed when the source and drain electrodes are formed using a conductive material that is easily bonded to oxygen. Examples of such a conductive material include Al, Cr, Cu, Ta, Ti, Mo, and W.

The oxide semiconductor film is not limited to a single metal oxide film and may have a stacked structure of a plurality of metal oxide films. In a semiconductor film in which first to third metal oxide films are sequentially stacked, for example, the first metal oxide film and the third metal oxide film are each an oxide film which contains at least one of the metal elements contained in the second metal oxide film and whose energy at the bottom of the conduction band is closer to the vacuum level than that of the second metal oxide film by 0.05 eV or more, 0.07 eV or more, 0.1 eV or more, or 0.15 eV or more and 2 eV or less, 1 eV or less, 0.5 eV or less, or 0.4 eV or less. Further, the second metal oxide film preferably contains at least indium in order to increase the carrier mobility.

In the transistor including the above semiconductor film, when a voltage is applied to the gate electrode so that an electric field is applied to the semiconductor film, a channel region is formed in the second metal oxide film, whose energy at the bottom of the conduction band is the lowest. That is, since the third metal oxide film is provided between the second metal oxide film and the gate insulating film, a channel region can be formed in the second metal oxide film which is insulated from the gate insulating film.

Since the third metal oxide film contains at least one of the metal elements contained in the second metal oxide film, interface scattering is unlikely to occur at the interface between the second metal oxide film and the third metal oxide film. Thus, the movement of carriers is unlikely to be inhibited at the interface, which results in an increase in the field-effect mobility of the transistor.

If an interface level is formed at the interface between the second metal oxide film and the first metal oxide film, a channel region is formed also in the vicinity of the interface, which causes a change in the threshold voltage of the transistor. However, since the first metal oxide film contains at least one of the metal elements contained in the second metal oxide film, an interface level is unlikely to be formed at the interface between the second metal oxide film and the first metal oxide film. Accordingly, the above structure can reduce variations in the electrical characteristics of the transistor, such as the threshold voltage.

Further, it is preferable that a plurality of metal oxide films be stacked so that an interface level due to impurities existing between the metal oxide films, which inhibits carrier flow, is not formed at the interface between the metal oxide films. This is because if impurities exist between the stacked metal oxide films, the continuity of the energy at the bottom of the conduction band between the metal oxide films is lost, and carriers are trapped or disappear by recombination in the vicinity of the interface. By reducing impurities existing between the films, a continuous junction (here, particularly a U-shape well structure with the energy at the bottom of the conduction band changed continuously between the films) is formed more easily than the case of merely stacking a plurality of metal oxide films that contain at least one common metal as a main component.

In order to form continuous junction, the films need to be stacked successively without being exposed to the air by using a multi-chamber deposition system (sputtering apparatus) provided with a load lock chamber. Each chamber of the sputtering apparatus is preferably evacuated to a high vacuum (to the degree of about $5\times10^{-7}$ Pa to $1\times10^{-4}$ Pa) by an adsorption vacuum pump such as a cryopump so that water and the like acting as impurities for the oxide semiconductor film are removed as much as possible. Alternatively, a combination of a turbo molecular pump and a cold trap is preferably used to prevent back-flow of a gas from an exhaust system into a chamber.

Not only high vacuum evacuation in a chamber but also high purity of a sputtering gas is necessary to obtain a high-purity intrinsic oxide semiconductor. As an oxygen gas or an argon gas used as the sputtering gas, a gas that is highly purified to have a dew point of −40° C. or lower, preferably −80° C. or lower, more preferably −100° C. or lower is used, so that entry of moisture or the like into the oxide semiconductor film can be prevented as much as possible. Specifically, when the second metal oxide film contains an In-M-Zn oxide (M represents Ga, Y, Zr, La, Ce, or Nd) and a target having the atomic ratio of metal elements of In:M:Zn=$x_1$:$y_1$:$z_1$ is used for forming the second metal oxide film, $x_1/y_1$ is preferably greater than or equal to ⅓ and less than or equal to 6, further preferably greater than or equal to 1 and less than or equal to 6, and $z_1/y_1$ is preferably greater than or equal to ⅓ and less than or equal to 6, further preferably greater than or equal to 1 and less than or equal to 6. Note that when $z_1/y_1$ is greater than or equal to 1 and less than or equal to 6, a CAAC-OS film is easily formed as the second metal oxide film. Typical examples of the atomic ratio of the metal elements of the target are In:M:Zn=1:1:1. In:M:Zn=3:1:2, and the like.

Specifically, when the first metal oxide film and the third metal oxide film contain an In-M-Zn oxide (M represents Ga, Y, Zr, La, Ce, or Nd) and a target having the atomic ratio of metal elements of In:M:Zn=$x_2$:$y_2$:$z_2$ is used for forming the first metal oxide film and the third metal oxide film, $x_2/y_2$ is preferably less than $x_1/y_1$, and $z_2/y_2$ is preferably greater than or equal to ⅓ and less than or equal to 6, further preferably greater than or equal to 1 and less than or equal to 6. Note that when $z_2/y_2$ is greater than or equal to 1 and less than or equal to 6, CAAC-OS films are easily formed as the first metal oxide film and the third metal oxide film. Typical examples of the atomic ratio of the metal elements of the target are In:M:Zn=1:3:2, In:M:Zn=1:3:4, In:M:Zn=1:3:6, In:M:Zn=1:3:8, and the like.

The thickness of the first metal oxide film and the third metal oxide film is greater than or equal to 3 nm and less than or equal to 100 nm, preferably greater than or equal to 3 nm and less than or equal to 50 nm. The thickness of the second metal oxide film is greater than or equal to 3 nm and less than or equal to 200 nm, preferably greater than or equal to 3 nm and less than or equal to 100 nm, further preferably greater than or equal to 3 nm and less than or equal to 50 nm.

In the three-layer semiconductor film, the first to third metal oxide films can be amorphous or crystalline. Note that the transistor can have stable electrical characteristics when the second metal oxide film where a channel region is formed is crystalline; therefore, the second metal oxide film is preferably crystalline.

Note that a channel formation region refers to a region of a semiconductor film of a transistor that overlaps with a gate electrode and is located between a source electrode and a drain electrode. Further, a channel region refers to a region through which current mainly flows in the channel formation region.

For example, when an In—Ga—Zn-based oxide film formed by a sputtering method is used as the first and third metal oxide films, a target that is an In—Ga—Zn-based oxide containing In, Ga, and Zn at an atomic ratio of 1:3:2 can be used to deposit the first and third metal oxide films. The deposition conditions can be as follows, for example: an argon gas (flow rate: 30 sccm) and an oxygen gas (flow rate: 15 sccm) are used as the deposition gas; the pressure is 0.4 Pa; the substrate temperature is 200° C.; and the DC power is 0.5 kW.

Further, when the second metal oxide film is a CAAC-OS film, a target including polycrystalline In—Ga—Zn-based oxide containing In, Ga, and Zn at an atomic ratio of 1:1:1 is preferably used to deposit the second metal oxide film. The deposition conditions can be as follows, for example: an argon gas (flow rate: 30 sccm) and an oxygen gas (flow rate: 15 sccm) are used as the deposition gas; the pressure is 0.4 Pa; the substrate temperature is 300° C.; and the DC power is 0.5 kW.

Note that the end portions of the semiconductor film in the transistor may be tapered or rounded.

Also in the case where a semiconductor film including stacked metal oxide films is used in the transistor, a region in contact with the source electrode or the drain electrode may be an n-type region. Such a structure increases the mobility and on-state current of the transistor and achieves high-speed operation of a semiconductor device using the transistor. Further, when the semiconductor film including the stacked metal oxide films is used in the transistor, the n-type region particularly preferably reaches the second metal oxide film part of which is to be a channel region, because the mobility and on-state current of the transistor are further increased and higher-speed operation of the semiconductor device is achieved.

<External View of Light-Emitting Device>

Figure 22:
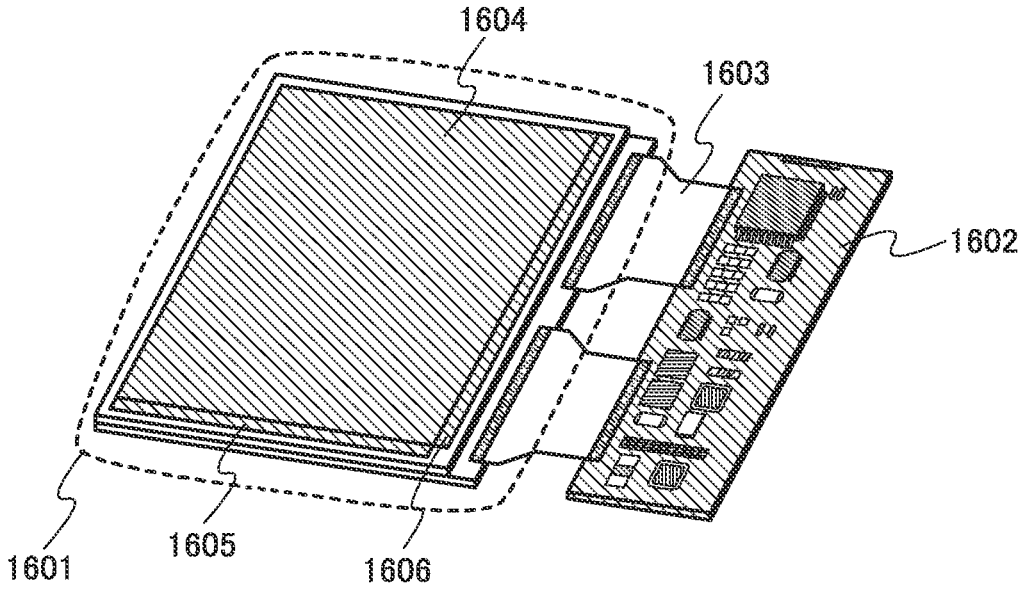
FIG. 22 is a perspective view of a light-emitting device.

FIG. 22 is a perspective view illustrating an example of an external view of a light-emitting device according to one embodiment of the present invention. The light-emitting device illustrated in FIG. 22 includes a panel 1601; a circuit board 1602 including a controller, a power supply circuit, an image processing circuit, an image memory, a CPU, and the like; and a connection portion 1603. The panel 1601 includes a pixel portion 1604 including a plurality of pixels, a driver circuit 1605 that selects pixels row by row, and a driver circuit 1606 that controls input of an image signal Sig to the pixels in a selected row.

A variety of signals and power supply potentials are input from the circuit board 1602 to the panel 1601 through the connection portion 1603. As the connection portion 1603, a flexible printed circuit (FPC) or the like can be used. In the case where a COF tape is used as the connection portion 1603, part of circuits in the circuit board 1602 or part of the driver circuit 1605 or the driver circuit 1606 included in the panel 1601 may be formed on a chip separately prepared, and the chip may be connected to the COF tape by a chip-on-film (COF) method.

Structural Example of Electronic Device

The light-emitting device according to one embodiment of the present invention can be used for display devices, notebook personal computers, or image reproducing devices provided with recording media (typically, devices which reproduce the content of recording media such as digital versatile discs (DVDs) and have displays for displaying the reproduced images). Other than the above, as an electronic device which can use the light-emitting device according to one embodiment of the present invention, cellular phones, portable game machines, portable information terminals, electronic books, cameras such as video cameras and digital still cameras, goggle-type displays (head mounted displays), navigation systems, audio reproducing devices (e.g., car audio systems and digital audio players), copiers, facsimiles, printers, multifunction printers, automated teller machines (ATM), vending machines, and the like can be given. Specific examples of these electronic devices are illustrated in FIGS. 23A to 23F.

Figure 23A:
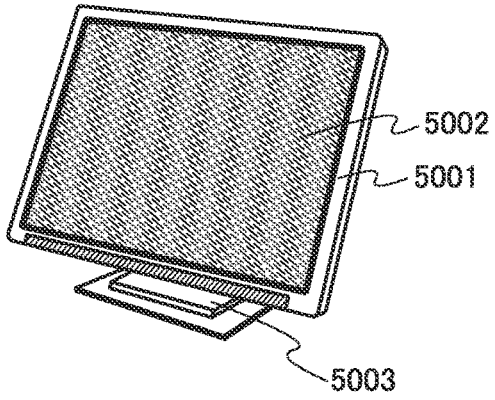
FIGS. 23A to 23F illustrate electronic devices.

FIG. 23A illustrates a display device including a housing 5001, a display portion 5002, a supporting base 5003, and the like. The light-emitting device according to one embodiment of the present invention can be used for the display portion 5002. Note that the display device includes all devices for displaying information such as for a personal computer, for receiving TV broadcasting, and for displaying an advertisement.

Figure 23B:
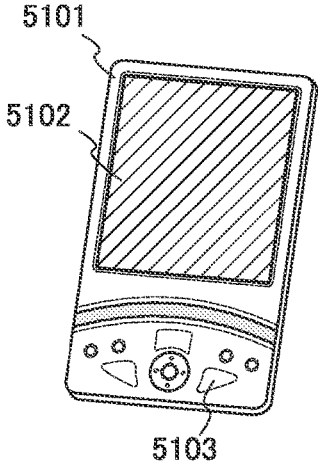

FIG. 23B illustrates a portable information terminal including a housing 5101, a display portion 5102, operation keys 5103, and the like. The light-emitting device according to one embodiment of the present invention can be used for the display portion 5102.

Figure 23C:
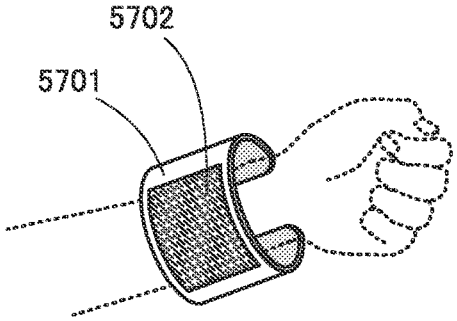

FIG. 23C illustrates a display device including a housing 5701 having a curved surface, a display portion 5702, and the like. When a flexible substrate is used for the light-emitting device according to one embodiment of the present invention, it is possible to use the light-emitting device as the display portion 5702 supported by the housing 5701 having a curved surface. Consequently, it is possible to provide a user-friendly display device that is flexible and lightweight.

Figure 23D:
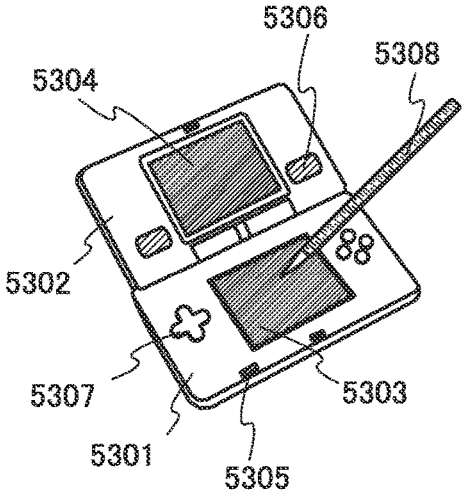

FIG. 23D illustrates a portable game machine including a housing 5301, a housing 5302, a display portion 5303, a display portion 5304, a microphone 5305, a speaker 5306, an operation key 5307, a stylus 5308, and the like. The light-emitting device according to one embodiment of the present invention can be used for the display portion 5303 or the display portion 5304. When the light-emitting device according to one embodiment of the present invention is used as the display portion 5303 or 5304, it is possible to provide a user-friendly portable game machine with quality that hardly deteriorates. Note that although the portable game machine illustrated in FIG. 23D includes the two display portions 5303 and 5304, the number of display portions included in the portable game machine is not limited to two.

Figure 23E:
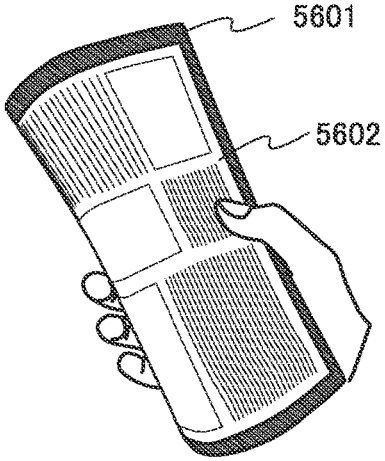

FIG. 23E illustrates an e-book reader, which includes a housing 5601, a display portion 5602, and the like. The light-emitting device according to one embodiment of the present invention can be used for the display portion 5602. When a flexible substrate is used, the light-emitting device can have flexibility, so that it is possible to provide a flexible and lightweight e-book reader.

Figure 23F:
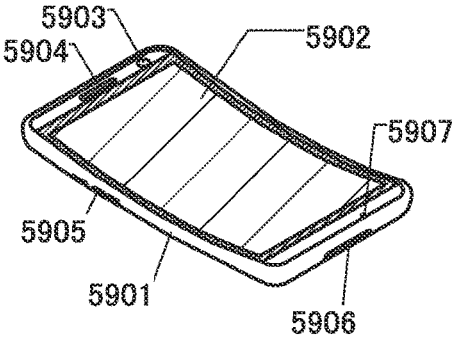

FIG. 23F illustrates a cellular phone, which includes a display portion 5902, a microphone 5907, a speaker 5904, a camera 5903, an external connection portion 5906, and an operation button 5905 in a housing 5901. It is possible to use the light-emitting device according to one embodiment of the present invention as the display portion 5902. When the light-emitting device according to one embodiment of the present invention is provided over a flexible substrate, the light-emitting device can be used as the display portion 5902 having a curved surface, as illustrated in FIG. 23F.

<Layout of Pixel>

Figure 24:
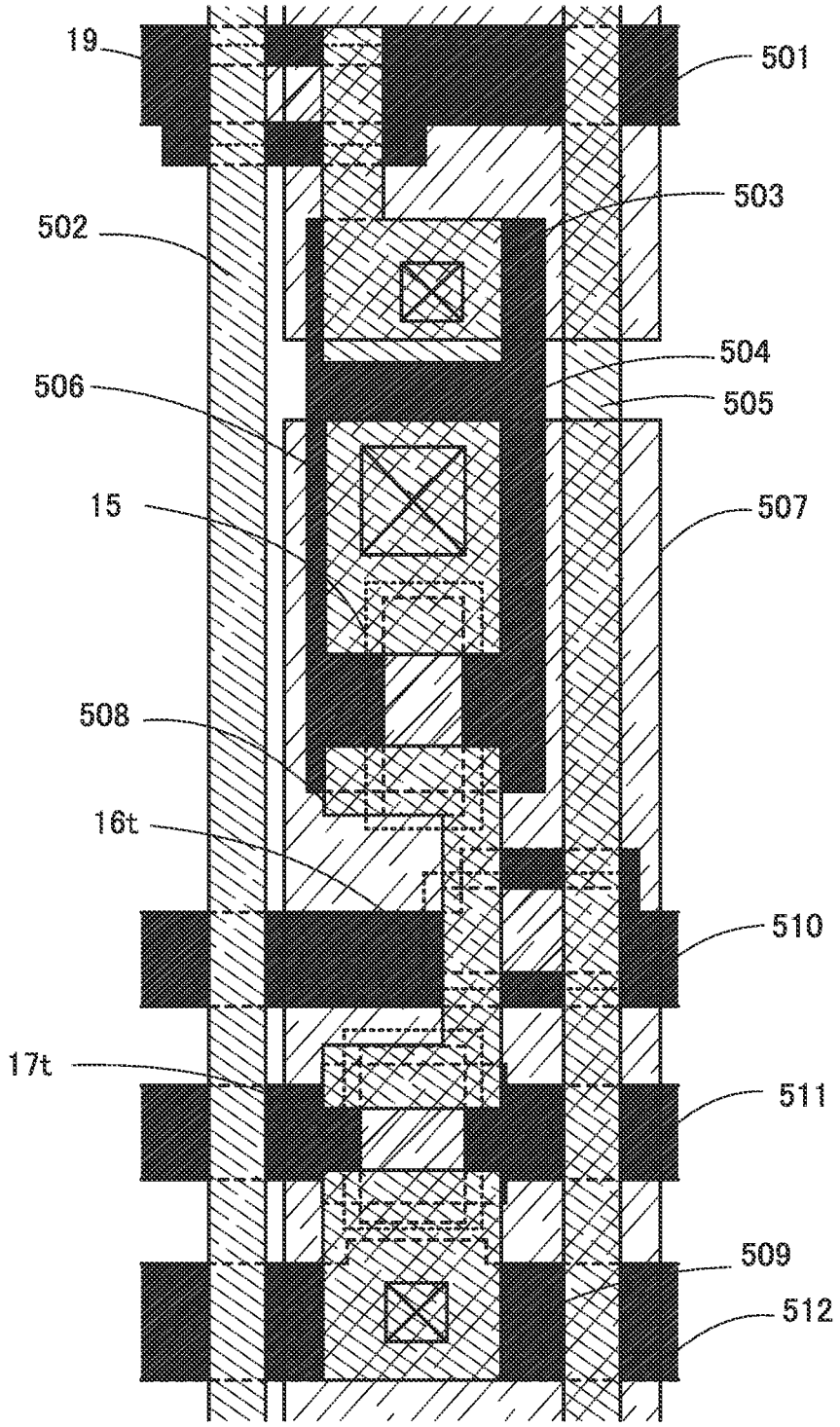
FIG. 24 illustrates a layout of a pixel.

Next, FIG. 24 illustrates an example of the layout of the pixel 11 in FIG. 3. Note that in FIG. 24, various insulating films such as a gate insulating film and an oxide film are omitted for clearly showing the layout of the pixel 11.

The pixel 11 illustrated in FIG. 24 includes the transistor 15, the transistor 16*t*, the transistor 17*t*, and the transistor 19. A conductive film 501 has a function as the gate of the transistor 19 and a function as the wiring GLa. A conductive film 502 has a function as the wiring SL and a function as the source or the drain of the transistor 19. A conductive film 503 has a function as the source or the drain of the transistor 19. A conductive film 504 has a function as the gate of the transistor 15 and is connected to the conductive film 503. A conductive film 505 has a function as the wiring VL and a function as the source or the drain of the transistor 16*t*. A conductive film 506 has a function as the source or the drain of the transistor 15. A conductive film 507 has a function as the pixel electrode of the light-emitting element 14 and is connected to the conductive film 506. A conductive film 508 has a function as the source or the drain of the transistor 15, a function as the source or the drain of the transistor 16*t*, and a function as the source or the drain of the transistor 17*t*. A conductive film 509 serves as the source or the drain of the transistor 17*t*. A conductive film 510 has a function as the wiring GLb and a function as the gate of the transistor 16*t*. A conductive film 511 has a function as the wiring GLc and a function as the gate of the transistor 17*t*. A conductive film 512 has a function as the wiring ML and is connected to the conductive film 509.

This application is based on Japanese Patent Application serial no. 2013-190038 filed with Japan Patent Office on Sep. 13, 2013, the entire contents of which are hereby incorporated by reference.

What is claimed is:

1. A light-emitting device comprising:

a pixel comprising:

a transistor, a value of current flowing through the transistor determined in accordance with an image signal;

a light-emitting element directly connected to a first terminal of the transistor;

a first switch, a terminal of the first switch electrically connected to a second terminal of the transistor;

a second switch, a first terminal of the second switch electrically connected to the second terminal of the transistor; and a first capacitor, a first terminal of the first capacitor electrically connected to a gate of the transistor and a second terminal of the first capacitor directly connected to the first terminal of the transistor;

a first circuit electrically connected to a second terminal of the second switch, the first circuit configured to generate a signal including information about the value of the current; and a second circuit electrically connected to the first circuit, the second circuit configured to correct the image signal in accordance with the signal.

2. The light-emitting device according to claim 1, wherein the transistor is an n-channel transistor.

3. The light-emitting device according to claim 1, wherein the transistor comprises a channel formation region in an oxide semiconductor film.

4. The light-emitting device according to claim 1, wherein each of the first switch and the second switch comprises a transistor comprising a channel formation region in an oxide semiconductor film.

5. The light-emitting device according to claim 1, wherein the first circuit comprises an operational amplifier, a second capacitor, and a third switch, wherein a first terminal of the second capacitor and a first terminal of the third switch are electrically connected to an input terminal of the operational amplifier, and wherein a second terminal of the second capacitor and a second terminal of the third switch are electrically connected to an output terminal of the operational amplifier.

6. The light-emitting device according to claim 1, further comprising a selection circuit electrically connected between the pixel and the first circuit.

7. A light-emitting device comprising:

a pixel comprising:

a transistor, a value of current flowing through the transistor determined in accordance with an image signal;

a light-emitting element directly connected to a first terminal of the transistor;

a first switch, a terminal of the first switch electrically connected to a second terminal of the transistor;

a second switch, a first terminal of the second switch electrically connected to the second terminal of the transistor;

a third switch, a terminal of the third switch electrically connected to the first terminal of the transistor and the light-emitting element; and a first capacitor, a first terminal of the first capacitor electrically connected to a gate of the transistor and a second terminal of the first capacitor directly connected to the first terminal of the transistor;

a first circuit electrically connected to a second terminal of the second switch, the first circuit configured to generate a signal including information about the value of the current; and a second circuit electrically connected to the first circuit, the second circuit configured to correct the image signal in accordance with the signal.

8. The light-emitting device according to claim 7, wherein the transistor is an n-channel transistor.

9. The light-emitting device according to claim 7, wherein the transistor comprises a channel formation region in an oxide semiconductor film.

10. The light-emitting device according to claim 7, wherein each of the first switch, the second switch, and the third switch comprises a transistor comprising a channel formation region in an oxide semiconductor film.

11. The light-emitting device according to claim 7, wherein the first circuit comprises an operational amplifier, a capacitor, and a fourth switch, wherein a first terminal of the capacitor and a first terminal of the fourth switch are electrically connected to an input terminal of the operational amplifier, and wherein a second terminal of the capacitor and a second terminal of the fourth switch are electrically connected to an output terminal of the operational amplifier.

12. The light-emitting device according to claim 7, further comprising a selection circuit electrically connected between the pixel and the first circuit.

13. A light-emitting device comprising:

a pixel comprising:

a first transistor, a gate of the first transistor electrically connected to a first wiring and a first terminal of the first transistor supplied with an image signal;

a second transistor, a gate of the second transistor electrically connected to a second terminal of the first transistor;

a light-emitting element directly connected to a first terminal of the second transistor;

a third transistor, a first terminal of the third transistor electrically connected to a second terminal of the second transistor;

a fourth transistor, a first terminal the fourth transistor electrically connected to the second terminal of the second transistor; and a first capacitor, a first terminal of the first capacitor electrically connected to the gate of the second transistor and a second terminal of the first capacitor directly connected to the first terminal of the second transistor;

a first circuit electrically connected to a second terminal of the fourth transistor, the first circuit configured to generate a signal including information about a value of current flowing through the second transistor; and a second circuit electrically connected to the first circuit, the second circuit configured to correct the image signal in accordance with the signal, wherein a gate of the third transistor is electrically connected to a second wiring and a gate of the fourth transistor is electrically connected to a third wiring.

14. The light-emitting device according to claim 13, wherein each of the first transistor and the second transistor is an n-channel transistor.

15. The light-emitting device according to claim 13, wherein each of the first transistor and the second transistor comprises a channel formation region in an oxide semiconductor film.

16. The light-emitting device according to claim 13, wherein each of the third transistor and the fourth transistor comprises a channel formation region in an oxide semiconductor film.

17. The light-emitting device according to claim 13, wherein the first circuit comprises an operational amplifier, a capacitor, and a switch, wherein a first terminal of the capacitor and a first terminal of the switch are electrically connected to an input terminal of the operational amplifier, and wherein a second terminal of the capacitor and a second terminal of the switch are electrically connected to an output terminal of the operational amplifier.

18. The light-emitting device according to claim 13, further comprising a selection circuit electrically connected between the pixel and the first circuit.

* * * * *